US006524726B1

(12) United States Patent
Kitano et al.

(10) Patent No.: US 6,524,726 B1
(45) **Date of Patent: *Feb. 25, 2003**

(54) COLD-ROLLED STEEL SHEET AND GALVANIZED STEEL SHEET, WHICH ARE EXCELLENT IN FORMABILITY, PANEL SHAPEABILITY, AND DENT-RESISTANCE, AND METHOD OF MANUFACTURING THE SAME

(75) Inventors: Fusato Kitano, Tokyo (JP); Masaya Morita, Tokyo (JP); Yoshihiro Hosoya, Tokyo (JP); Takeshi Fujita, Tokyo (JP); Tadashi Inoue, Tokyo (JP); Masahiro Iwabuchi, Tokyo (JP); Takeo Ishii, Toyota (JP)

(73) Assignee: NKK Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/446,708

(22) PCT Filed: Sep. 24, 1998

(86) PCT No.: PCT/JP98/04283

§ 371 (c)(1),
(2), (4) Date: Dec. 23, 1999

(87) PCT Pub. No.: WO99/55927

PCT Pub. Date: Nov. 4, 1999

(30) Foreign Application Priority Data

Apr. 27, 1998 (JP) ..... 10-116778

(51) Int. Cl.[7] ..... C22C 38/12; C21D 8/02; B32B 15/02

(52) U.S. Cl. ..... 428/659; 148/533; 148/541; 148/651; 148/337; 420/121; 420/126

(58) Field of Search ..... 148/533, 541, 148/650, 651, 337; 420/121, 126, 127; 428/659

(56) References Cited

U.S. PATENT DOCUMENTS

| | | | | |
|---|---|---|---|---|
| 3,765,874 A | * | 10/1973 | Elias et al. | 420/127 |
| 4,586,966 A | * | 5/1986 | Okamoto et al. | 148/541 |
| 4,956,025 A | | 9/1990 | Koyama et al. | |
| 5,019,460 A | | 5/1991 | Yasuda et al. | |
| 5,041,166 A | | 8/1991 | Matsuoka et al. | |
| 5,085,714 A | | 2/1992 | Kitamura et al. | |
| 5,089,068 A | | 2/1992 | Okada et al. | |
| 5,133,815 A | | 7/1992 | Hashimoto et al. | |

(List continued on next page.)

FOREIGN PATENT DOCUMENTS

| | | | | |
|---|---|---|---|---|
| JP | 59-153837 | * | 9/1984 | 148/541 |
| JP | 6-108153 | | 4/1994 | |
| JP | 8-41585 | | 2/1996 | |
| JP | 8-41587 | | 2/1996 | |

OTHER PUBLICATIONS

Metals Handbook, 10$^{th}$ edition, vol. 1, pp. 398–408.

*Primary Examiner*—George Wyszomierski
(74) *Attorney, Agent, or Firm*—Nixon & Vanderhye

(57) ABSTRACT

Disclosed is a cold-rolled steel sheet excellent in formability, panel shapeability and dent-resistance, comprising 0.005 to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, not higher than 0.004% by weight of N (N≦0.004%), not higher than 0.003% by weight of O (O≦0.003%), 0.04 to 0.23% by weight of Nb, 1.0≦(Nb %×12)/(C %×93)≦3.0, and a balance of Fe and unavoidable impurities, said cold-rolled steel sheet meeting the relationship given below:

$$\exp(\epsilon)\times(5.29\times\exp(\epsilon)-4.19)\leqq\sigma/\sigma_{0.2}\leqq\exp(\epsilon)\times(5.64\times\exp(\epsilon)-4.49)$$

where $0.002<\epsilon\geqq0.096$, $\epsilon$ represents a true strain, $\sigma_{0.2}$ represents a 0.2% proof stress, and $\sigma$ represents a true stress relative to $\epsilon$.

7 Claims, 12 Drawing Sheets

U.S. PATENT DOCUMENTS

| | | | | | |
|---|---|---|---|---|---|
| 5,356,493 | A | | 10/1994 | Tsuyama et al. | |
| 5,360,493 | A | | 11/1994 | Matsuoka et al. | |
| 5,360,676 | A | | 11/1994 | Kuguminato et al. | |
| 5,384,206 | A | | 1/1995 | Ushioda et al. | |
| 5,460,665 | A | | 10/1995 | Yasuhara et al. | |
| 5,496,420 | A | | 3/1996 | Kuguminato et al. | |
| 5,531,839 | A | | 7/1996 | Hosoya et al. | |
| 5,542,994 | A | | 8/1996 | Seto et al. | |
| 5,690,755 | A | | 11/1997 | Yoshinaga et al. | |
| 5,853,903 | A | * | 12/1998 | Hosoya et al. | 420/127 |
| 6,217,680 | B1 | * | 4/2001 | Kawabata et al. | 148/651 |
| 6,273,971 | B1 | * | 8/2001 | Kitano et al. | 148/541 |

* cited by examiner

| | C (wt%) | (Nb × 12) / (C × 93) | B (wt%) | 2%BH (MPa) | 2, 4, 8%P0. 1 (N) | δ (%) | REMARKS |
|---|---|---|---|---|---|---|---|
| ○ | 0. 0060～0. 0080 | 1. 4～1. 6 | 0. 0003～0. 0006 | 0 | 165～200 | 3～5 | STEEL OF PRESENT INVENTION |
| ○ | 0. 0060～0. 0080 | 1. 2～1. 8 | tr. | 0 | 160～195 | | |
| ○ | | | | | 160～185 | 7～10 | STEEL OF COMPAR-ATIVE EXAMPLE |
| ● | 0. 0060～0. 0080 | 1. 2～1. 8 | tr. | 0 | 140～175 | 2～5 | |
| ▲ | 0. 0020～0. 0040 | | | | | | |
| △ | 0. 0025～0. 0045 | 0. 5～0. 7 | tr. | 30～45 | 160～190 | 7～9 | |

| | C (wt%) | (Nb × 12) / (C × 93) | B (wt%) | 2%BH (MPa) | 2, 4, 8%P0. 1 (N) | δ (%) | REMARKS |
|---|---|---|---|---|---|---|---|
| ○ | 0. 0060～0. 0080 | 1. 4～1. 6 | 0. 0003～0. 0006 | 0 | 165～200 | 3～5 | STEEL OF PRESENT INVENTION |
| ○ | 0. 0060～0. 0080 | 1. 2～1. 8 | tr. | 0 | 160～195 | | |
| ○ | | | | | 160～185 | 7～10 | STEEL OF COMPAR -ATIVE EXAMPLE |
| ● | 0. 0060～0. 0080 | 1. 2～1. 8 | tr. | 0 | 140～175 | 2～5 | |
| ▲ | 0. 0020～0. 0040 | | | | | | |
| △ | 0. 0025～0. 0045 | 0. 5～0. 7 | tr. | 30～45 | 160～190 | 7～9 | |

| | C (wt%) | (Nb × 12) / (C × 93) | B (wt%) | 2%BH (MPa) | 2, 4, 8%P0. 1 (N) | δ (%) | REMARKS |
|---|---|---|---|---|---|---|---|
| ○ | 0. 0060～0. 0080 | 1. 4～1. 6 | 0. 0003～0. 0006 | 0 | 165～200 | 3～5 | STEEL OF PRESENT INVENTION |
| ○ | 0. 0060～0. 0080 | 1. 2～1. 8 | tr. | 0 | 160～195 | | |
| ○ | | | | | 160～185 | 7～10 | STEEL OF COMPAR-ATIVE EXAMPLE |
| ● | 0. 0060～0. 0080 | 1. 2～1. 8 | tr. | 0 | 140～175 | 2～5 | |
| ▲ | 0. 0020～0. 0040 | | | | | | |
| △ | 0. 0025～0. 0045 | 0. 5～0. 7 | tr. | 30～45 | 160～190 | 7～9 | |

STEEL SAMPLE No. 3 OF EXAMPLE 1

| Wca (μm) \ 2%P0.1 (N) | 140～150 | 155～165 | |
|---|---|---|---|
| δ % | ≦4 | ≦4 | 8～10 |
| ≦0.2 | | ○ | |
| 0.2～0.4 | ◐ | | ◑ |
| 0.4～0.6 | ● | | |

| | |
|---|---|
| $C^*=C-(12/93)Nb-(12/48)Ti^*$ | CASE OF Nb OR Ti ADDITION |
| $C-(12/91)Zr^*$ | CASE OF Zr ADDITION ($Zr^*=Zr-(91/14)N-(91/32)S$) |
| $C-(12/51)V$ | CASE OF V ADDITION |

| | | 2, 4, 8% P0.1 (N) | 2%BH (MPa) | δ (%) | REMARKS |
|---|---|---|---|---|---|
| C=0.004 ~0.01wt% C*=-0.0008 ~0.002wt% | ○Ti,B ADDITION | 170~210 | 0~20 | 2~5 | STEEL OF PRESENT INVEN-TION |
| | △Nb ADDITION | 160~200 | 0~15 | 3~6 | |
| | □Nb,Ti ADDITION | 160~190 | | | |
| | ▽Ti ADDITION | 160~200 | 0~20 | 2~6 | |
| | ▲Nb ADDITION | 180~210 | 30~45 | 7~11 | STEEL OF COMPAR-ATIVE EXAMPLE |
| | ▼Zr ADDITION | 170~200 | 0~25 | | |
| | ■V ADDITION | 160~200 | 0~25 | | |
| | ●Ti,B ADDITION | 145~165 | 0~20 | 2~5 | |
| | ◭Nb ADDITION | 140~160 | 0~15 | 1~5 | |
| C=0.001 ~0.0035wt% C*=-0.0004 ~0.0015wt% | ◭Nb ADDITION | 140~180 | 30~45 | 5~9 | |

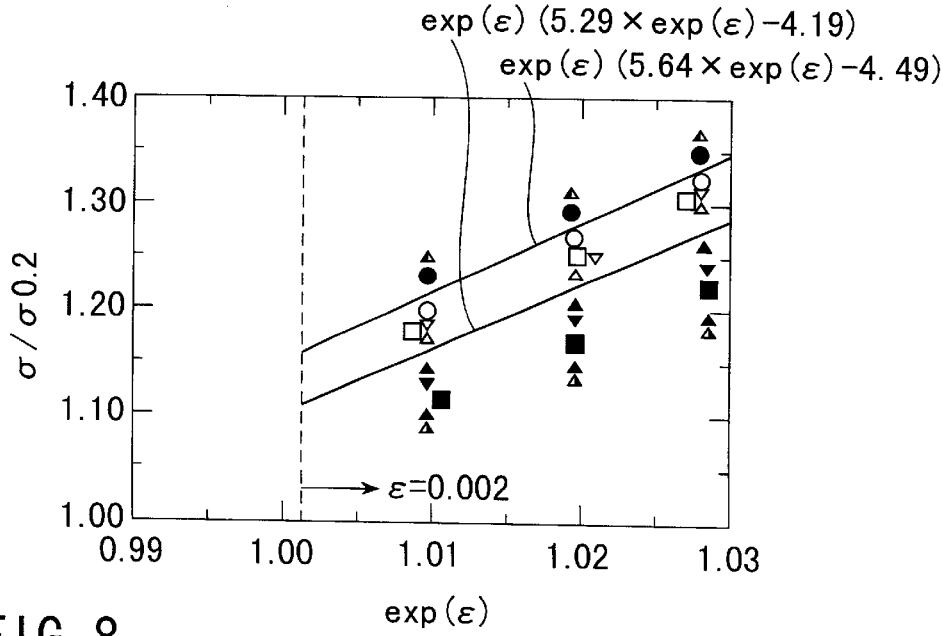

FIG. 8

| | |
|---|---|
| $C^*=C-(12/93)Nb-(12/48)Ti^*$ | CASE OF Nb OR Ti ADDITION |
| $C-(12/91)Zr^*$ | CASE OF Zr ADDITION ($Zr^*=Zr-(91/14)N-(91/32)S$) |
| $C-(12/51)V$ | CASE OF V ADDITION |

| | | 2, 4, 8% P0.1 (N) | 2%BH (MPa) | δ (%) | REMARKS |
|---|---|---|---|---|---|
| C=0.004 ~0.01wt% C*=-0.0008 ~0.002wt% | ○Ti, B ADDITION | 170~210 | 0~20 | 2~5 | STEEL OF PRESENT INVEN-TION |
| | △Nb ADDITION | 160~200 | 0~15 | 3~6 | |
| | □Nb, Ti ADDITION | 160~190 | | | |
| | ▽Ti ADDITION | 160~200 | 0~20 | 2~6 | |
| | ▲Nb ADDITION | 180~210 | 30~45 | 7~11 | STEEL OF COMPAR-ATIVE EXAMPLE |
| | ▼Zr ADDITION | 170~200 | 0~25 | | |
| | ■V ADDITION | 160~200 | 0~25 | | |
| | ●Ti, B ADDITION | 145~165 | 0~20 | 2~5 | |
| | ◭Nb ADDITION | 140~160 | 0~15 | 1~5 | |
| C=0.001 ~0.0035wt% C*=-0.0004 ~0.0015wt% | ◭Nb ADDITION | 140~180 | 30~45 | 5~9 | |

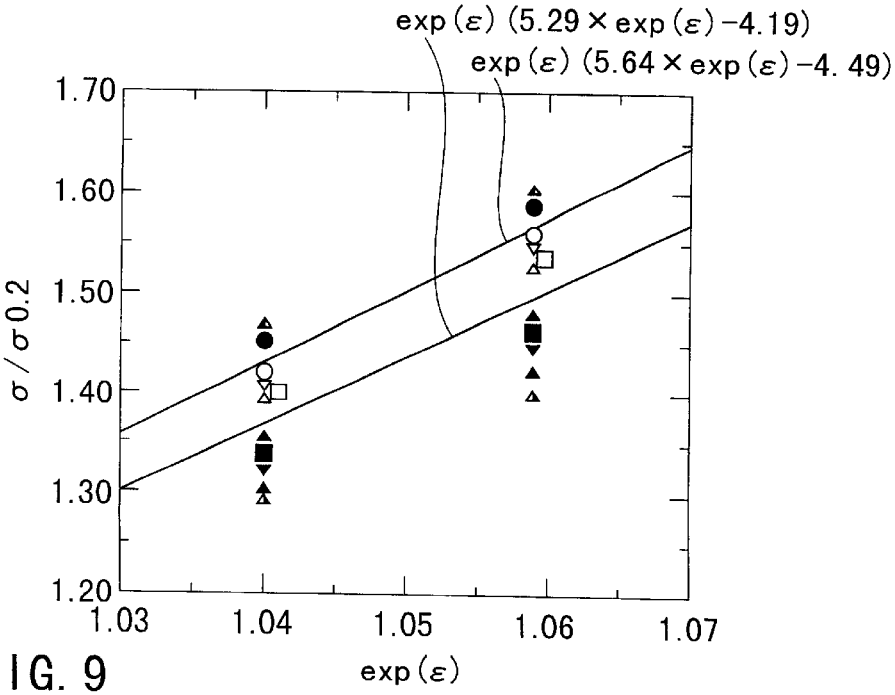

FIG. 9

| | |
|---|---|
| $C^*=C-(12/93)Nb-(12/48)Ti^*$ | CASE OF Nb OR Ti ADDITION |
| $C-(12/91)Zr^*$ | CASE OF Zr ADDITION ($Zr^*=Zr-(91/14)N-(91/32)S$) |
| $C-(12/51)V$ | CASE OF V ADDITION |

| | | 2, 4, 8% P0.1 (N) | 2%BH (MPa) | δ (%) | REMARKS |
|---|---|---|---|---|---|
| C=0.004 ~0.01wt% C*=-0.0008 ~0.002wt% | ○Ti,B ADDITION | 170~210 | 0~20 | 2~5 | STEEL OF PRESENT INVEN-TION |
| | △Nb ADDITION | 160~200 | 0~15 | 3~6 | |
| | □Nb,Ti ADDITION | 160~190 | | | |
| | ▽Ti ADDITION | 160~200 | 0~20 | 2~6 | |
| | ▲Nb ADDITION | 180~210 | 30~45 | 7~11 | STEEL OF COMPAR-ATIVE EXAMPLE |
| | ▼Zr ADDITION | 170~200 | 0~25 | | |
| | ■V ADDITION | 160~200 | 0~25 | | |
| | ●Ti,B ADDITION | 145~165 | 0~20 | 2~5 | |
| | ◭Nb ADDITION | 140~160 | 0~15 | 1~5 | |
| C=0.001 ~0.0035wt% C*=-0.0004 ~0.0015wt% | ◭Nb ADDITION | 140~180 | 30~45 | 5~9 | |

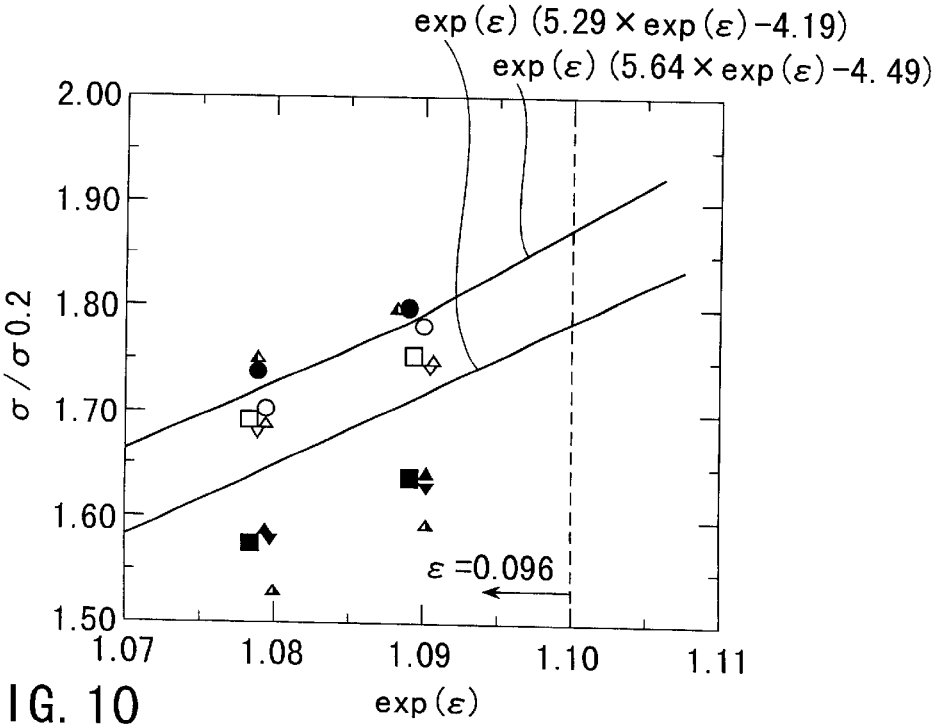

FIG. 10

STEEL SAMPLE No. 8 OF EXAMPLE 1

| Wca (μm) \ 2%P0.1(N) | δ ≦6% | | δ=7～10% | |
|---|---|---|---|---|
| | 140～155 | 156～165 | 156～165 | 165～175 |
| ≦0.2 | | ○ | | |
| 0.2 ～ 0.4 | ◐ | ◔ | ◑ | ◕ |
| 0.4 ～ 0.6 | ◐ | ◔ | | |

COLD-ROLLED STEEL SHEET AND GALVANIZED STEEL SHEET, WHICH ARE EXCELLENT IN FORMABILITY, PANEL SHAPEABILITY, AND DENT-RESISTANCE, AND METHOD OF MANUFACTURING THE SAME

TECHNICAL FIELD

The present invention relates to a cold-rolled steel sheet and a galvanized steel sheet, which are excellent in formability, panel shapeability, and dent-resistance required for an outer panel of a motor car, and a method of manufacturing the same.

BACKGROUND ART

An excellent formability, a satisfactory shape after a panel formation and a high dent-resistance (resistance to local depression) are required for a steel sheet for an outer panel of a motor car. The panel formability is evaluated by indexes such as yield strength, elongation, and an n-value (work-hardening index) of the steel sheet. Also, the panel shapeability and the dent-resistance are evaluated in many cases by yield strength and the yield strength after the working and the coating-baking treatment. If the yield strength of the steel sheet is weakened, the press formability can be improved. However, the dent-resistance after the panel formation is rendered unsatisfactory. On the other hand, if the yield strength of the steel sheet is increased, the dent-resistance is improved. However, problems are generated in terms of the press formability such as occurrence of wrinkles or cracks. Such being the situation, vigorous researches are being made in an attempt to obtain a steel sheet having a low yield point in the press forming and a high yield strength after the forming and baking as an outer panel for a motor car. As a cold-rolled steel sheet meeting these two contradictory requirements in terms of the yield strength, a bake-hardenable steel sheet, hereinafter referred to as a "BH steel sheet", utilizing a strain aging phenomenon of the carbon atoms within the steel has been developed.

Particularly, known is a method of manufacturing a BH steel sheet having an excellent deep drawability, which is a cold-rolled steel sheet prepared by adding elements capable of forming carbonitrides such as Nb and Ti to a steel having a very low carbon content of about 50 ppm, the addition amount of such an element being not larger than 1 in terms of the atomic ratio of carbon. For example, Japanese Patent Publication (Kokoku) No. 60-46166 teaches that a Nb or Ti added low-carbon steel is annealed at a high temperature close to 900° C. for manufacturing the particular BH steel sheet. Also, Japanese Patent Disclosure (Kokai) No. 61-276928 teaches that an extra low carbon BH steel sheet is manufactured by annealing under a temperature region of about 700 to 850° C.

The technology disclosed in JP '166 is certainly advantageous in that the BH properties and an r-value can be improved. However, since the annealing is performed at a high temperature, the rough surface derived from enlargement of the ferrite grains is worried about. In addition, since the steel sheet itself is softened, the yield strength after the press forming and the baking steps is not acceptably high, though high BH properties may be obtained. On the other hand, in the technology disclosed in JP '928, the annealing temperature is relatively low, compared with that employed in JP '166, and, thus, is desirable in the required surface properties and the yield strength. However, it is substantially impossible to improve as desired the BH properties and the r-value. It should also be noted that these prior arts are mainly intended to improve the BH properties of a steel sheet in order to allow the steel sheet to exhibit an improved dent-resistance. Therefore, deterioration in the resistance to natural aging, i.e., occurrence of stretcher strain in the press forming, which is derived from generation of a yield point elongation during storage under room temperature, is worried about. Under the circumstances, the BH amount is suppressed at 60 MPa or less in view of the practical use of the steel sheet.

As described above, the cold-rolled sheet manufactured by the conventional method is not sufficiently satisfactory in the surface properties, the resistance to natural aging, and the dent-resistance, which are required for the steel sheet used for an outer panel of a motor car.

An object of the present invention is to provide a cold-rolled steel sheet and a galvanized steel sheet, which are satisfactory in any of the surface properties, the resistance to natural aging, and the dent-resistance, which are required for the steel sheet used for an outer panel of a motor car, and a method of manufacturing the same.

DISCLOSURE OF INVENTION (1) The present invention provides a cold-rolled steel sheet excellent in formability, panel shapeability and dent-resistance, comprising 0.005 to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, not higher than 0.004% by weight of N, not higher than 0.003% by weight of O, 0.04 to 0.23% by weight of Nb, the amounts of Nb and C meeting the relationship given in formula (1), and a balance of Fe and unavoidable impurities, the cold-rolled steel sheet meeting the relationship given in formula (2):

$$1.0 \leqq (\text{Nb } \% \times 12)/(\text{C } \% \times 93) \leqq 3.0 \quad (1)$$

$$\exp(\epsilon) \times (5.29 \times \exp(\epsilon) - 4.19) \leqq \sigma/\sigma_{0.2} \leqq \exp(\epsilon) \times (5.64 \times \exp(\epsilon) - 4.49) \quad (2)$$

where $0.002 < \epsilon \leqq 0.096$, $\epsilon$ represents a true strain, $\sigma_{0.2}$ represents a 0.2% proof stress, and a represents a true stress relative to $\sigma$.

(2) The present invention provides the cold-rolled steel sheet excellent in formability, panel shapeability and dent-resistance defined in item (1) above, further comprising 0.0001 to 0.002% by weight of B.

(3) The present invention provides a galvanized steel sheet excellent in formability, panel shapeability and dent-resistance, which is obtained by applying a galvanizing to the cold-rolled steel sheet defined in item (1) or item (2) above.

(4) The present invention provides a method of manufacturing a cold-rolled steel sheet excellent in formability, panel shapeability and dent-resistance defined in item (1) or item (2) above, comprising the steps of:

preparing a molten steel and continuously casting the steel;

applying a hot-rolling process such that a finish rolling is performed at $(Ar_3-100)$° C. or more and the rolled steel sheet is coiled at 500 to 700° C.; and continuously applying a cold-rolling process and an annealing process to the hot-rolled steel sheet.

(5) The present invention provides a method of manufacturing a galvanized steel sheet, the steel sheet being excellent in formability, panel shapeability and dent-resistance, defined in item (3) above, comprising the steps of:

preparing a molten steel and continuously casting the steel;

applying a hot-rolling process such that a finish rolling is performed at $(Ar_3-100)°$ C. or more and the rolled steel sheet is coiled at 500 to 700° C.; and continuously applying a cold-rolling process and a galvanizing process to the hot-rolled steel sheet.

(6) The present invention provides a cold-rolled steel sheet excellent in the surface shape of a panel and dent-resistance, comprising 0.004 to 0.015% by weight of C, 0.01 to 0.2% by weight of Si, 0.1 to 1.5% by weight of Mn, 0.01 to 0.07% by weight of P, 0.005 to 0.015% by weight of S, 0.01 to 0.08% by weight of sol. Al, not higher than 0.005% by weight of N, and at least one kind of the element selected from the group consisting of 0.02 to 0.12% by weight of Nb and 0.03 to 0.1% by weight of Ti, the amount of C, Nb, Ti, N and S meeting the relationship given in formula (1), and a balance of Fe and unavoidable impurities, the cold-rolled steel sheet meeting the relationship given in formula (2):

$$-0.001 \leqq C\ \%-(12/93)Nb\ \%-(12/48)Ti^* \leqq 0.001 \quad (1)$$

where $Ti^*=Ti\ \%-(48/14)N\ \%-(48/32)S\ \%$, when $Ti^*$ is not larger than 0, $Ti^*$ is regarded as 0.

$$\exp(\epsilon)\times(5.29\times\exp(\epsilon)-4.19) \leqq \sigma/\sigma_{0.2} \leqq \exp(\epsilon)\times(5.64\times\exp(\epsilon)-4.49) \quad (2)$$

where $0.002 < \epsilon \leqq 0.096$, $\epsilon$ represents a true strain, $\sigma 0.2$ represents a 0.2% proof stress, and $\sigma$ represents a true stress relative to $\epsilon$.

(7) The present invention provides a cold-rolled steel sheet excellent in the surface shape of a panel and dent-resistance defined in item (6) above, further comprising 0.0001 to 0.002% by weight of B.

(8) The present invention provides a galvanized steel sheet, the steel sheet being excellent in the surface shape of a panel and dent-resistance and prepared by applying a galvanizing to the cold-rolled steel sheet defined in item (6) or item (7) above.

(9) The present invention provides a method of manufacturing a cold-rolled steel sheet excellent in the surface shape of a panel and dent-resistance and defined in item (6) or item (7) above, comprising the steps of:

applying a hot-rolling process after preparation of a molten steel and continuous casting of the steel such that a finish rolling is performed at $(Ar_3-100)°$ C. or more and the rolled steel sheet is coiled at 500 to 700° C.; and continuously applying a cold-rolling process and an annealing process to the hot-rolled steel sheet.

(10) The present invention provides a method of manufacturing a galvanized steel sheet, the steel sheet being excellent in the surface shape of a panel and dent-resistance and defined in item (8) above, comprising the steps of:

applying a hot-rolling process after preparation of an ingot steel and continuous casting of the ingot steel such that a finish rolling is performed at $(Ar_3-100)°$ C. or more and the rolled steel sheet is coiled up at 500 to 700° C.; and continuously applying a cold-rolling treatment and a galvanizing treatment to the hot-rolled steel band.

BRIEF DESCRIPTION OF DRAWINGS

FIG. 8 is a graph showing how P0.1 (dent-resistance load of a panel imparted with strains of 2%, 4% and 8%) and $\delta$ (spring back amount of 2% panel) are affected by $\sigma/\sigma_{0.2}$, $\exp(\epsilon)$, and components of the steel composition according to the second embodiment of the present invention;

FIG. 9 is a graph showing how P0.1 (dent-resistance load of a panel imparted with strains of 2%, 4% and 8%) and $\delta$ (spring back amount of 2% panel) are affected by $\sigma/\sigma_{0.2}$, $\exp(\epsilon)$, and components of the steel composition according to the second embodiment of the present invention;

FIG. 10 is a graph showing how P0.1 (dent-resistance load of a panel imparted with strains of 2%, 4% and 8%) and $\delta$ (spring back amount of 2% panel) are affected by $\sigma/\sigma_{0.2}$, $\exp(\epsilon)$, and components of the steel composition according to the second embodiment of the present invention;

BEST MODE OF CARRYING OUT THE INVENTION

Figure 1A:
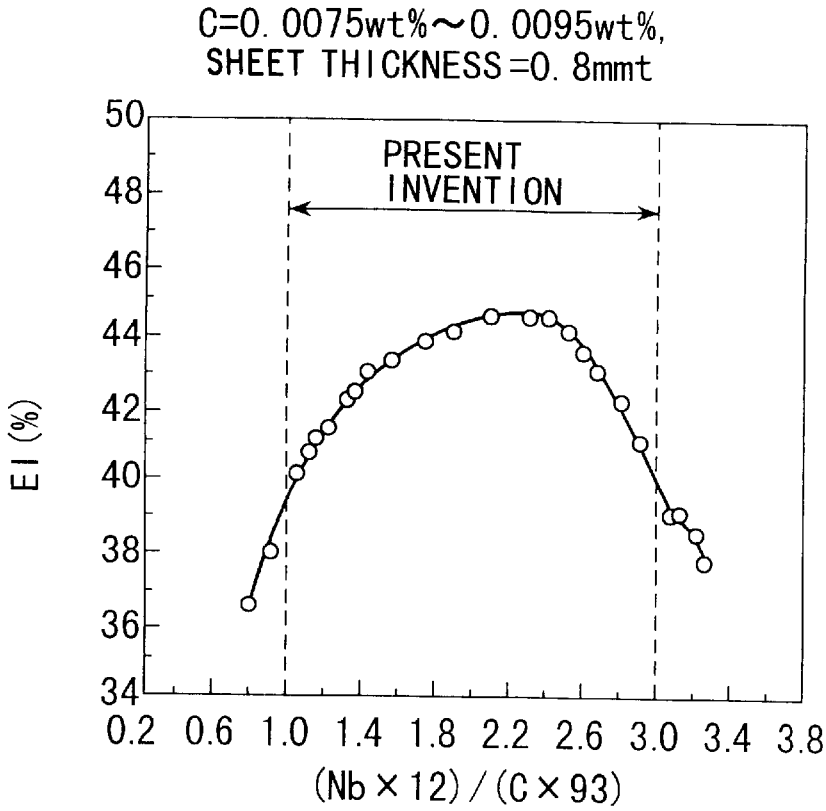
FIGS. 1A and 1B show the relationships between the elongation El and (Nb×12)/(C×93) and between the r-value and (Nb×12)/(C×93) according to a first embodiment of the present invention.

The present inventors have conducted an extensive research in an attempt to obtain a cold-rolled steel sheet and a galvanized steel sheet, which are excellent in the surface properties, the resistance to natural aging and the dent-resistance required for the steel used for an outer panel of a motor car, and a method of manufacturing the same.

As a result, it has been found that the dent-resistance of a panel can be improved by an alloy design with an emphasis placed on the work-hardening behavior in a low strain region in the panel forming step, unlike the prior art in which the dent-resistance required for ah outer panel of a motor car is improved by increasing the BH value. It has also been found that good surface properties and resistance to natural aging can be imparted to the steel sheet by positively suppressing the BH value. These findings have enabled the present inventors to develop a technology for stably manufacturing a cold-rolled steel sheet and a galvanized steel sheet, being excellent in the panel surface shapeability and the dent-resistance and exhibiting such a high tensile strength as at least 340 MPa.

Some embodiments of the present invention will now be described.

First Embodiment

Described in the following are the reasons for using the additives, the reasons for limiting the amounts of the additives, the reasons for limiting the tensile characteristics, and the reasons for limiting the manufacturing conditions according to the first embodiment of the present invention. In the following description, "%" represents "% by weight".

(1) Amounts of Additives

C: 0.005 to 0.015%

A carbide formed together with Nb affects the work-hardening in a low strain region in panel forming step and contributes to an improvement of the dent-resistance. The particular effect cannot be obtained, if the C amount is less than 0.005%. Also, if the C amount exceeds 0.015%, the dent-resistance of the panel is certainly improved. However, the shape of the panel is impaired. It follows that the C amount should fall within a range of between 0.005 and 0.015%.

Si: 0.01 to 0.2%

Silicon is effective for strengthening the steel. However, if the Si amount is smaller than 0.01%, it is impossible to obtain a capability of the solid solution strengthening. On the other hand, if the Si amount is larger than 0.2%, the surface properties of the steel sheet are impaired. In addition, striped surface defects are generated after galvanizing. Therefore, the Si amount should fall within a range of between 0.01 and 0.2%.

Mn: 0.2 to 1.5%

Manganese serves to precipitate sulfide and to suppress deterioration of the hot ductility. Also, Mn is effective for strengthening the steel. If the Mn amount is less than 0.2%, hot brittleness of the steel sheet is brought about, leading to a low yield. In addition, a high mechanical strength characterizing the steel sheet of the present invention cannot be obtained. Further, Mn, which relates to an improvement in the workability of the steel sheet, is necessary for controlling the morphology of the MnS in the hot rolling step. It should be noted that fine MnS particles are formed by the process of resolution and re-precipitation in the hot rolling step. These MnS particles impair the grain growth of the steel. However, if Mn is added in an amount not smaller than 0.2%, it is possible to eliminate the above-noted adverse effect produced by the presence of the MnS particles. In order to control effectively the morphology of the MnS particles in the hot rolling step, it is more desirable to add Mn in an amount of at least 0.45%. However, if the Mn amount exceeds 1.5%, the steel sheet is hardened and the panel shapeability of the steel sheet are deteriorated. It follows that Mn amount should fall within a range of between 0.2% and 1.5%.

P: 0.01 to 0.07%

Phosphorus is most effective for the solid solution strengthening of steel. If the P amount is smaller than 0.01%, however, P fails to exhibit a sufficient strengthening capability. On the other hand, if the P amount exceeds 0.07%, the ductility of the steel sheet is deteriorated. Also, a defective coating is brought about in the step of the alloying treatment during the continuous galvanizing process. It follows that the P amount should fall within a range of between 0.01 and 0.07%.

S: 0.006 to 0.015%

Sulfur, if added in an amount exceeding 0.015%, brings about hot brittleness of the steel. If the S amount is smaller than 0.006%, however, the peeling capability of the scale is impaired in the hot rolling step, and surface defects tend to be generated markedly. It follows that the S amount should fall within a range of between 0.006 and 0.015%.

Sol. Al: 0.01 to 0.08%

Aluminum serves to deoxidize the steel and fix N as nitride. If the Al amount is smaller than 0.01%, however, the deoxidation and the fixation of N cannot be achieved sufficiently. On the other hand, if the Al amount is larger than 0.08%, the surface properties of the steel sheet are deteriorated. Therefore, the Al amount should fall within a range of between 0.01 and 0.08%.

N≦0.004%

Nitrogen is fixed in the form of AlN. If the N amount exceeds 0.004%, however, it is impossible to obtain a desired formability of the steel sheet. Naturally, the N amount should not exceed 0.004%.

O≦0.003%

Oxygen forms inclusions involving oxides so as to adversely affect the grain growth of the steel. If the O amount exceeds 0.003%, the grain growth is impaired in the annealing step, resulting in failure to obtain satisfactory formability and panel shapeability. Naturally, the O amount should not exceed 0.003%. In order to suppress the O amount at 0.003% or less in the steel of the composition specified in the present invention, it is necessary to employ optimum manufacturing conditions. For example, the sol. Al should be controlled at a suitable level, and O should be controlled up in the process steps after the secondary refining process.

Nb: 0.04 to 0.23%

Niobium is bonded to C to form fine carbide particles. These fine carbide particles affect the work-hardening behavior in the panel forming step so as to contribute to an improvement in the dent-resistance of the panel. If the Nb amount is smaller than 0.04%, however, it is impossible to obtain the particular effect. On the other hand, if the Nb amount exceeds 0.23%, the panel shapeability such as the spring back and the surface deflection is deteriorated, though the dent-resistance is certainly improved. Naturally, the Nb amount should fall within a range of between 0.04 and 0.23%.

(Nb×12)/(C×93): 1.0 to 3.0

Figure 1B:
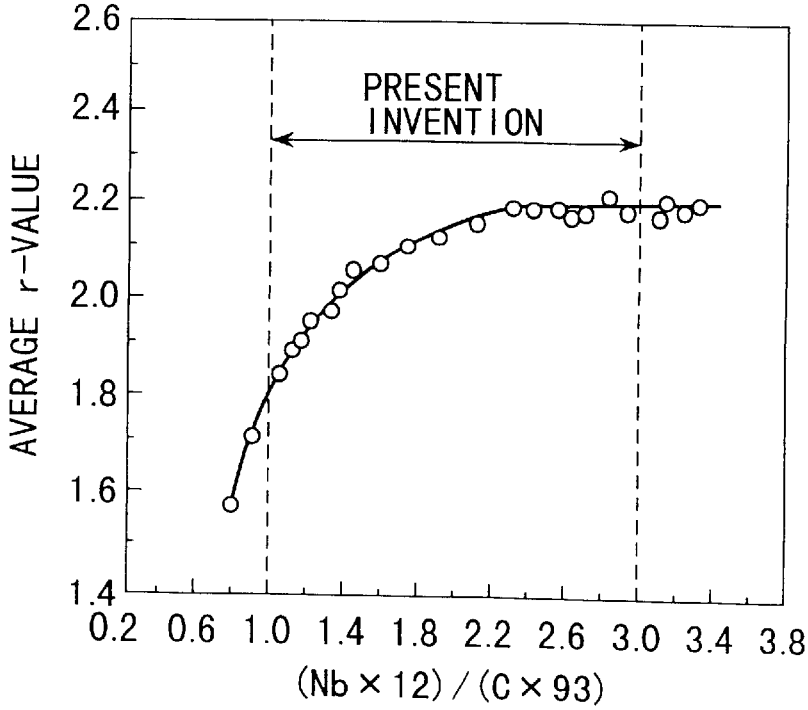

In the present invention, it is absolutely necessary to control (Nb×12)/(C×93) in order to improve the formability of the steel sheet. If the value of (Nb×12)/(C×93) is less than 1.0, C cannot be fixed sufficiently, resulting in failure to obtain a high r-value and a high ductility aimed at in the present invention. If the value exceeds 3.0, however, the amount of Nb forming a solid solution is rendered excessively high, leading to a low ductility. In this case, it is impossible to obtain a formability aimed at in the present invention. It follows that the value of (Nb×12)/(C×93) should fall within a range of between 1.0 and 3.0. FIGS. 1A and 1B show the relationships between the elongation El and (Nb×12)/(C×93) and between the r-value and (Nb×12)/(C×93).

In order to improve the dent-resistance as desired, it is desirable to add B in an amount given below in addition to the additives described above.

B: 0.0001 to 0.002%

If B is added, the grain boundary is strengthened so as to improve the resistance to the secondary working brittleness. Also, the ferrite grains are diminished so as to ensure an absolute value of the yield strength and, thus, to improve the dent-resistance. However, these effects cannot be obtained if the B amount is smaller than 0.0001%. On the other hand, if the B amount exceeds 0.002%, the yield point is increased and, thus, the panel shapeability is impaired. It follows that the B amount should fall within a range of between 0.0001 and 0.002%.

(2) Tensile Characteristics $\exp(\epsilon)\times(5.29\times\exp(\epsilon)-4.19)\leqq\sigma/\sigma_{0.2}\leqq\exp(\epsilon)\times(5.64\times\exp(\epsilon)-4.49)$, where $0.002\leqq\epsilon 0.096$, $\epsilon$ represents a true strain, $\sigma_{0.2}$ represents a 0.2% proof stress, and a represents a true stress relative to $\epsilon$.

In the steel sheet of the present invention comprising the additives described in item (1) above, Fe and unavoidable impurities, a ratio of flow stress a obtained by a tensile test under the condition that a true strain $\epsilon$ is larger than 0.002 and not larger than 0.096, i.e., $0.002<\epsilon\leqq 0.096$, to a 0.2% proof stress $\sigma_{0.2}$ i.e., $\sigma/\sigma_{0.2}$, should fall within a range of between $\exp(\epsilon)\times(5.29\times\exp(\epsilon)-4.19)$ and $\exp(\epsilon)\times(5.64\times\exp(\epsilon)-4.49)$.

Figure 2:
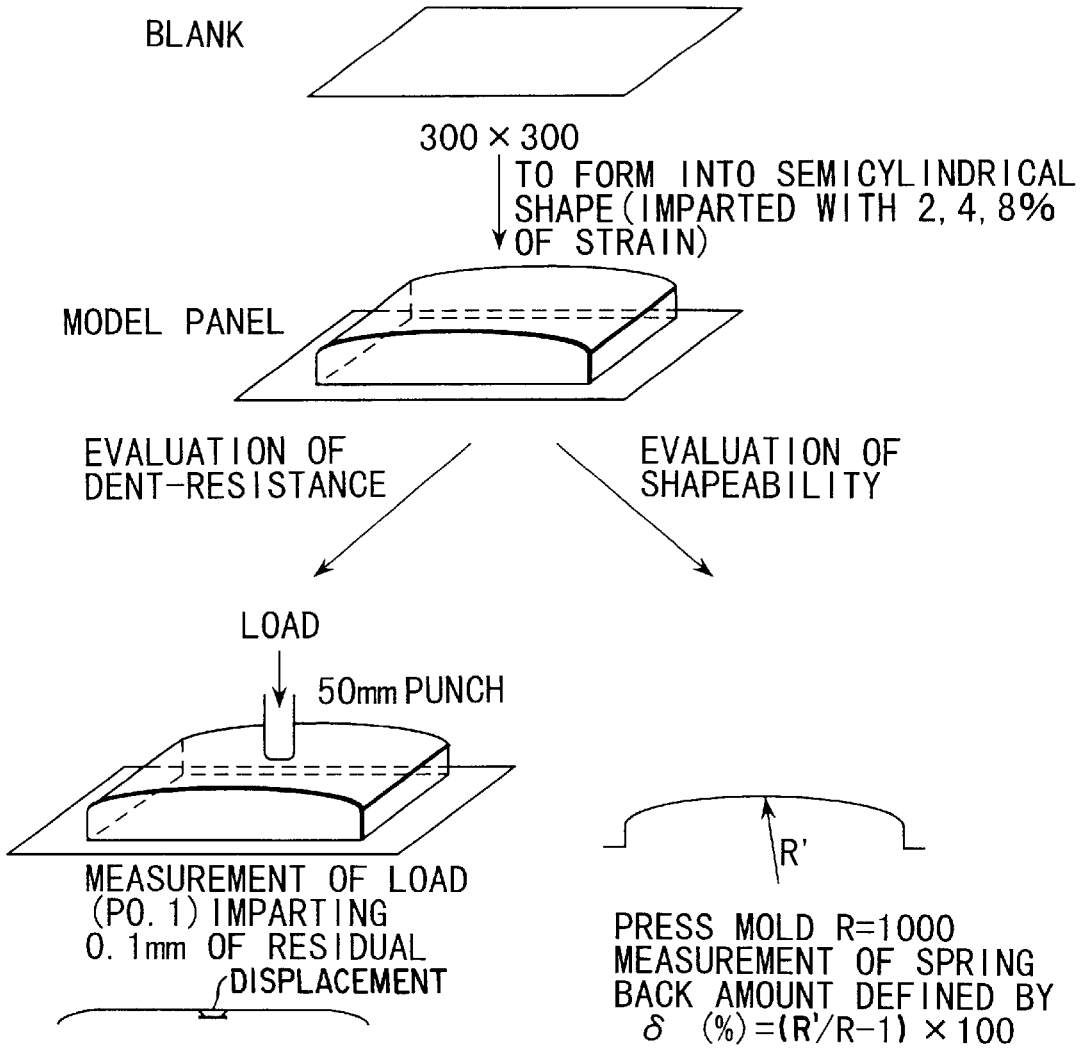
FIG. 2 shows a method of evaluating the dent-resistance and the shapeability according to the first embodiment of the present invention.
Figure 3:
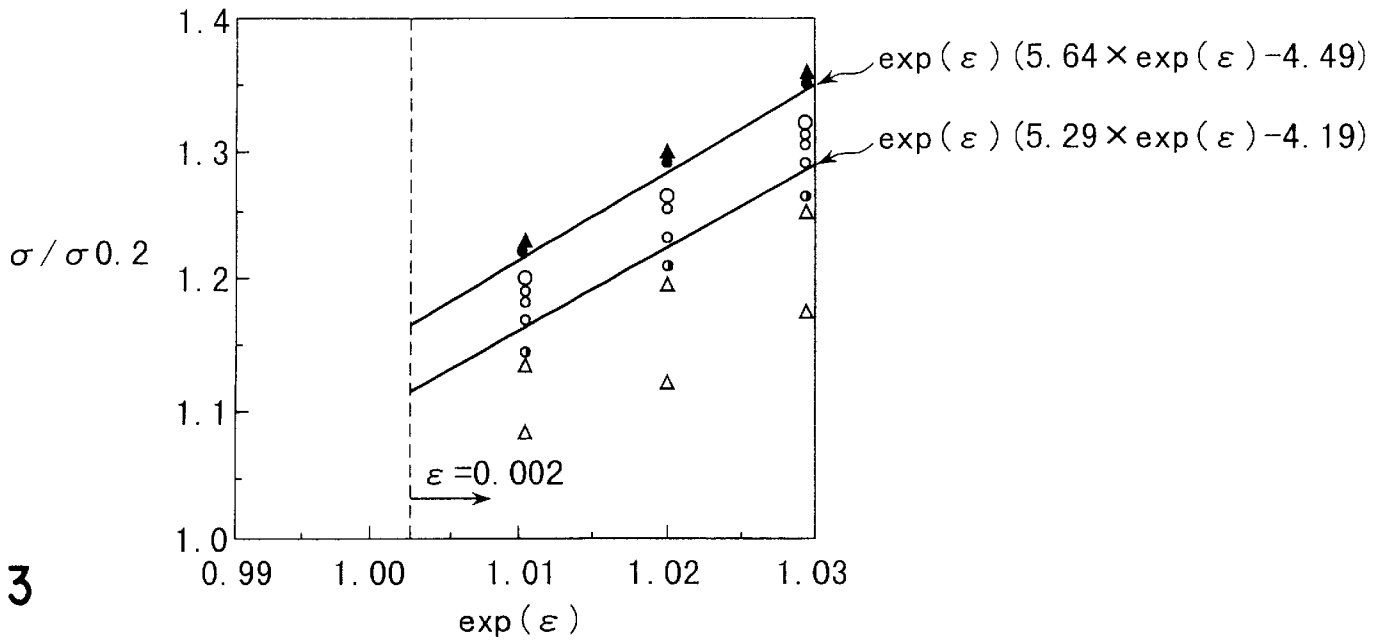
FIG. 3 is a graph showing how P0.1 (dent-resistance load of a panel imparted with strains of 2%, 4% and 8%) and $\delta$ (spring back amount of 2% panel) are affected by $\sigma/\sigma_{0.2}$ $\exp(\epsilon)$, and components of the steel composition according to the first embodiment of the present invention.
Figure 4:
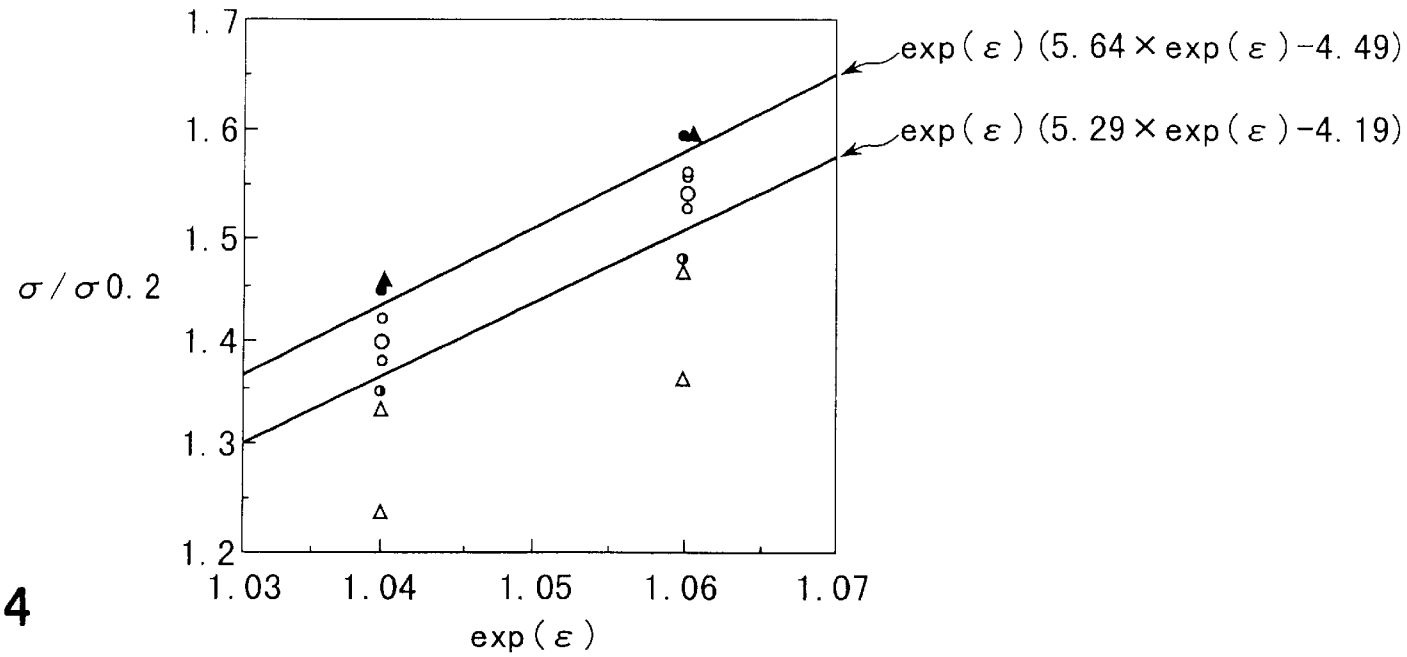
FIG. 4 is a graph showing how P0.1 (dent-resistance load of a panel imparted with strains of 2%, 4% and 8%) and $\delta$ (spring back amount of 2% panel) are affected by $\sigma/\sigma_{0.2}$, $\exp(\epsilon)$, and components of the steel composition according to the first embodiment of the present invention.
Figure 5:
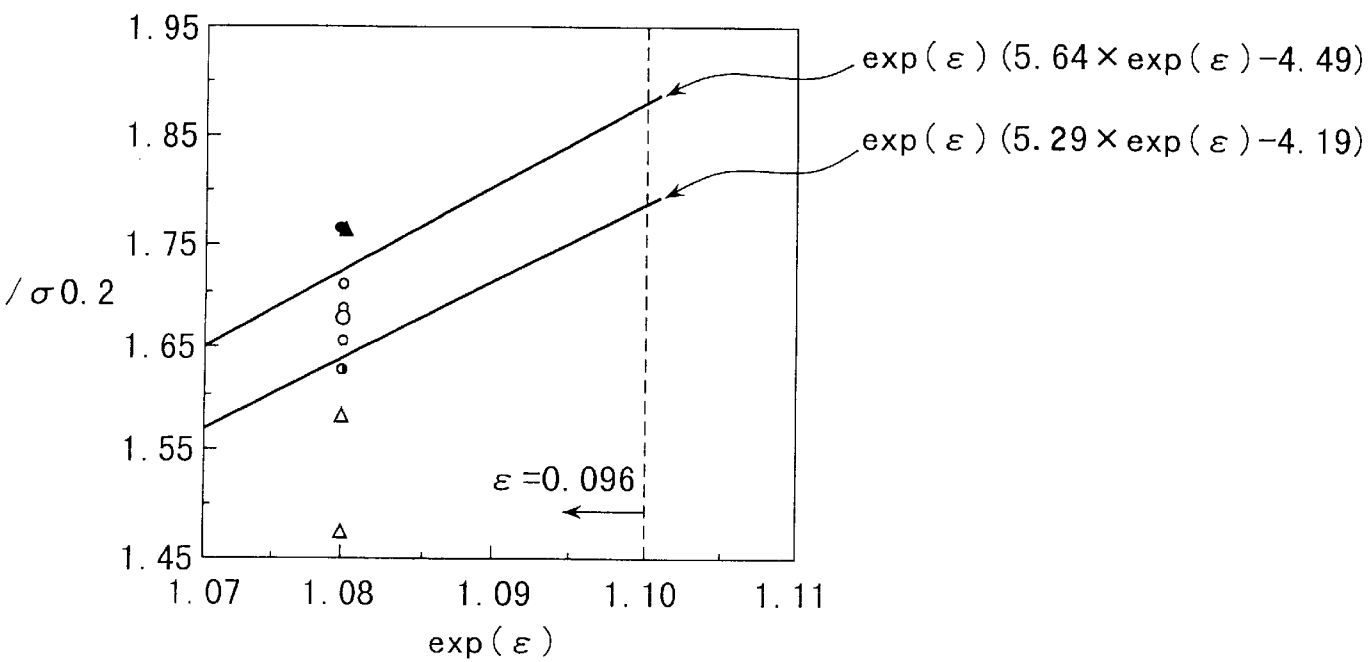
FIG. 5 is a graph showing how P0.1 (dent-resistance load of a panel imparted with strains of 2%, 4% and 8%) and $\delta$ (spring back amount of 2% panel) are affected by $\sigma/\sigma_{0.2}$, $\exp(\epsilon)$, and components of the steel composition according to the first embodiment of the present invention.

If the ratio $\sigma/\sigma_{0.2}$ is lower than the lower limit noted above, the dent-resistance load under the conditions of 2%P0.1, 4%P0.1, 8%P0.1 is as high as 160 to 190N as shown in FIGS. 3 to 5. For measuring the dent-resistance load, a steel sheet is formed to a model panel shown in FIG. 2 with strain of 2%, 4% or 8% imparted to the steel sheet, followed by applying a heat treatment at 170° C. for 20 minutes. Then, measured is a load required for imparting a residual displacement of 0.1 mm to the model panel. However, the spring back $\delta$ (measured for a panel having a strain of 2%) is as large as 7 to 10% so as to impair the panel shapeability, if the ratio $\sigma/\sigma_{0.2}$ is lower than the lower limit noted above. On the other hand, if the ratio $\sigma/\sigma_{0.2}$ is higher than the upper limit noted above, the spring back $\delta$ is as small as 2 to 5% to improve the panel shapeability. However, the dent-resistance is as low as 140 to 175N. In other words, the dent-resistance cannot be improved. Under the circumstances, the ratio $\sigma/\sigma_{0.2}$ should fall within a range of between $\exp(\epsilon)\times(5.29\times\exp(\epsilon)-4.19)$ and $\exp(\epsilon)\times(5.64\times\exp(\epsilon)-4.49)$.

A cold-rolled steel sheet and a galvanized steel sheet excellent in the panel surface properties and the dent-resistance required for the steel used for an outer panel of a motor car can be obtained by controlling the additive components as described in item (1) above and the tensile characteristics as described in item (2) above.

The steel sheet exhibiting the particular properties can be manufactured as follows.

(3) Steel Sheet Manufacturing Process

Figure 6:
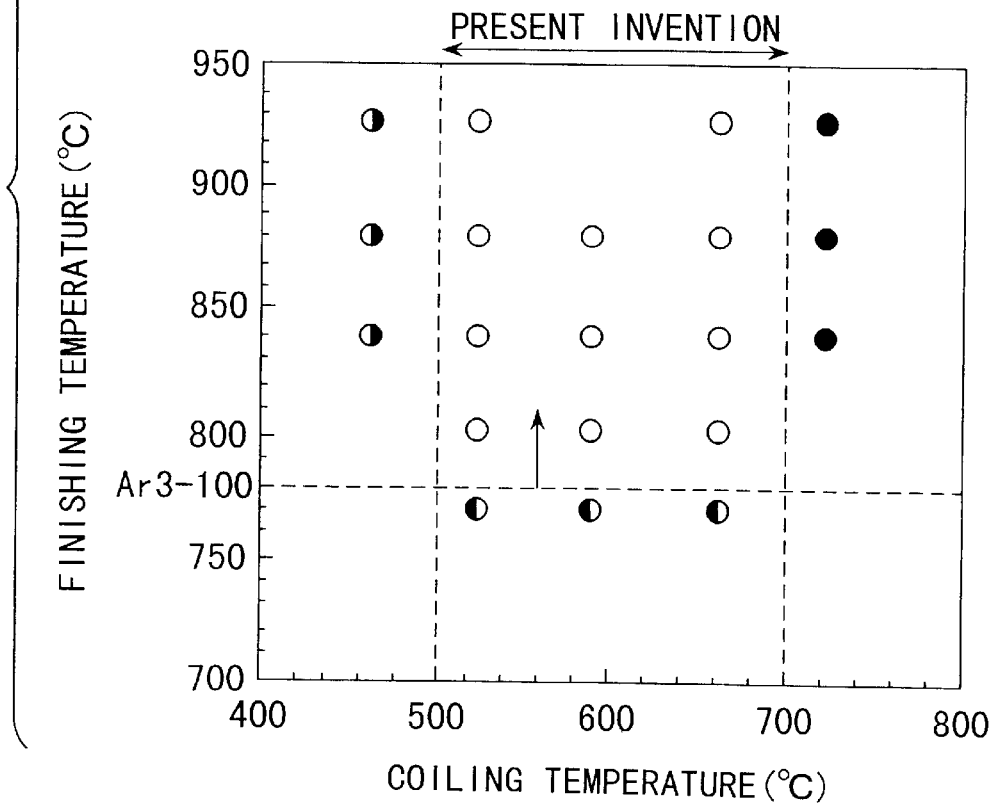
FIG. 6 is a graph showing how the finishing temperature and the coiling temperature have an influence on P0.1 (dent-resistance load of a panel imparted with strains of 2%), $\delta$, and Wca (Arithmetic Average Waviness Height) according to the first embodiment of the present invention.

In the first step, steel of the composition given in item (1) above is melted. A converter method is generally employed for melting the steel composition, or an electric furnace method can also be employed. After the molten steel is continuously cast to obtain a slab, the slab is heated immediately after the casting, or after the slab is once cooled, for applying a hot rolling. The hot rolling is performed under the conditions that the finishing temperature is set at temperature not less than $(Ar_3-100)$° C. and that the coiling temperature is set at 500° C. to 700° C. If the finishing temperature is lower than $(Ar_3-100)$° C., 2%P0.1, i.e., the dent-resistance load of the panel imparted with 2% of strain) is as low as 140 to 150N, as shown in FIG. 6. In other words, the dent-resistance of the panel cannot be improved. Also, where the coiling temperature is lower than 500° C., the value of 2%P0.1 is high, i.e., 155 to 165N. However, the value of $\delta$, i.e., the spring back amount of the panel imparted with 2% of strain, is as large as 8% to 10%, leading to a poor shapeability. On the other hand, where the coiling temperature exceeds 700° C., the value of Wca (i.e., Arithmetic Average Waviness Height; measuring length of 25 mm; average of the values measured at 10 optional points around the apex of the panel) is large, which falls within a range of between a value exceeding 0.4 $\mu$m and 0.6 $\mu$m, leading to a poor panel shapeability. It follows that the finishing temperature should be not lower than $(Ar_3-100)$° C. and that the coiling temperature should fall within a range of between 500° C. and 700° C.

In the next step, the hot-rolled steel band is subjected to pickling, cold-rolling and, then, a continuous annealing. Alternatively, galvanizing is applied after the continuous annealing. The cold-rolling reduction should desirably be at least 70% in order to improve the deep drawability (r-value) of the steel sheet. The annealing should desirably be carried out within a recrystallization temperature region of the ferrite phase. Further, the coating employed in the present invention is not limited to continuous galvanizing. Specifically, even if a surface treatment such as coating with zinc phosphate or an electrolytic galvanizing is applied to the steel sheet obtained by the continuous annealing, no problem is brought about in the characteristics of the resultant steel sheet.

Second Embodiment

Described in the following are the reasons for using the additives, the reasons for limiting the amounts of the additives, the reasons for limiting the tensile characteristics, and the reasons for limiting the manufacturing conditions according to the second embodiment of the present invention. In the following description, "%" represents "% by weight".

(1) Amounts of Additives

C: 0.004 to 0.015%

A carbide formed together with Nb or Ti affects the work-hardening in a low strain region in the panel forming step and contributes to an improvement of the dent-resistance. The particular effect cannot be obtained, if the C amount is less than 0.004%. Also, if the C amount exceeds 0.015%, the dent-resistance of the panel is certainly improved. However, the shape of the panel is impaired. It follows that the C amount should fall within a range of between 0.004 and 0.015%.

Si: 0.01 to 0.2%

Silicon is effective for strengthening the steel. However, if the Si amount is smaller than 0.01%, it is impossible to obtain a capability of strengthening. On the other hand, if the Si amount is larger than 0.2%, the surface properties of the steel sheet are impaired. In addition, striped surface defects are generated after galvanizing. Therefore, the Si amount should fall within a range of between 0.01 and 0.2%.

Mn: 0.1 to 1.5%

Manganese serves to precipitate sulfide and to suppress deterioration of the hot ductility. Also, Mn is effective for strengthening the steel. If the Mn amount is less than 0.1%, hot brittleness of the steel sheet is brought about. However, if the Mn amount exceeds 1.5%, the steel sheet is hardened and the panel shapeability of the steel sheet is deteriorated. It follows that Mn amount should fall within a range of between 0.1% and 1.5%.

P: 0.01 to 0.07%

Phosphorus is most effective for strengthening the steel. If the P amount is smaller than 0.01%, however, P fails to exhibit a sufficient strengthening capability. On the other hand, if the P amount exceeds 0.07%, the ductility of the steel sheet is deteriorated. Also, a defective coating is brought about in the step of the alloying treatment during the process of the continuous galvanizing. It follows that the P amount should fall within a range of between 0.01 and 0.07%.

S: 0.005 to 0.015%

Sulfur, if added in an amount exceeding 0.015%, brings about hot brittleness of the steel. However, the S amount smaller than 0.005% is undesirable in terms of the manufacturing cost of the desired steel sheet because a desulfurization treatment and a degassing treatment of the molten steel are required. It follows that the S amount should fall within a range of between 0.005 and 0.015%.

Sol. Al: 0.01 to 0.08%

Aluminum serves to deoxidize the steel. If the Al amount is smaller than 0.01%, however, the deoxidation cannot be achieved sufficiently. On the other hand, if the Al amount is larger than 0.08%, the surface properties of the steel sheet are deteriorated. Therefore, the Al amount should fall within a range of between 0.01 and 0.08%.

N≦0.005%

Nitrogen is fixed in the form of TiN. If the N amount exceeds 0.005%, however, the resistance to natural aging is deteriorated. Naturally, the N amount should not exceed 0.005%.

Nb: 0.02 to 0.12%

Niobium is bonded to C to form fine carbide particles. These fine carbide particles affect the work-hardening behavior in the panel forming step so as to contribute to an improvement in the dent-resistance of the panel. If the Nb amount is smaller than 0.02%, however, it is impossible to obtain the particular effect. On the other hand, if the Nb amount exceeds 0.12%, the panel shapeability such as the spring back and the surface deflection is deteriorated, though the dent-resistance is certainly improved. Naturally, the Nb amount should fall within a range of between 0.02 and 0.12%.

Ti: 0.03 to 0.1%

Like Nb, Ti forms fine carbide particles. These fine carbide particles greatly contribute to an improvement in.the dent-resistance of the panel. If the Ti amount is smaller than 0.03%, however, it is impossible to obtain the particular effect. On the other hand, if the Ti amount exceeds 0.1%, the panel shapeability is deteriorated. Also, the surface of the galvanized steel sheet is impaired. Naturally, the Ti amount should fall within a range of between 0.03 and 0.1%.

$$-0.001 \leqq C\,\% - (12/93)Nb\,\% - (12/48)Ti^* \leqq 0.001,$$

where $Ti^* = Ti\,\% - (48/14)N\,\% - (48/32)S\,\%$, when $Ti^*$ is not larger than 0, $Ti^*$ is regarded as 0.

In the present invention, the value of $C\,\% - (12/93)Nb\,\% - (12/48)Ti^*$ (where $Ti^* = Ti\,\% - (48/14)N\,\% - (48/32)S\,\%$, when $Ti^*$ is not larger than 0, $Ti^*$ is regarded as 0, which is defined by C, Nb and Ti) should be at least −0.001% and should not exceed 0.001%. If the value exceeds 0.001%, the resistance to natural aging is deteriorated. Also, if the value is smaller than −0.001%, Nb forming a solid solution or Ti forming a solid solution is increased so as to impair the surface properties of the steel sheet and increase the yield point, leading to deterioration of the panel shapeability.

In the present invention, it is also possible to add B in an amount given below in addition to the additives described above in order to improve the resistance to the secondary working brittleness and the dent-resistance.

B: 0.0001 to 0.002%

If B is added, the grain boundary is strengthened so as to improve the resistance to the secondary working brittleness. Also, the ferrite grains are diminished so as to ensure an absolute value of the yield strength and, thus, to improve the dent-resistance. However, these effects cannot be obtained if the B amount is smaller than 0.0001%. On the other hand, if the B amount exceeds 0.002%, the yield point is increased and, thus, the panel shapeability is impaired. It follows that the B amount should fall within a range of between 0.0001 and 0.002%.

(2) Tensile Characteristics $\exp(\epsilon)\times(5.29\times\exp(\epsilon)-4.19) \leqq \sigma/\sigma_{0.2} \leqq \exp(\epsilon)\times(5.64\times\exp(\epsilon)-4.49)$, where $0.002<\epsilon\leqq 0.096$, $\epsilon$ represents a true strain, $\sigma_{0.2}$ represents a 0.2% proof stress, and $\sigma$ represents a true stress relative to $\epsilon$.

In the steel sheet of the present invention comprising the additives described in item (1) above, Fe and unavoidable impurities, a ratio of flow stress a obtained by a tensile test under the condition that a true strain $\epsilon$ is larger than 0.002 and not larger than 0.096, i.e., $0.002<\epsilon\leqq 0.096$, to a 0.2% proof stress $\sigma_{0.2}$, i.e., $\sigma/\sigma_{0.2}$, should fall within a range of between $\exp(\epsilon)\times(5.29\times\exp(\epsilon)-4.19)$ and $\exp(\epsilon)\times(5.64\times\exp(\epsilon)-4.49)$.

If the ratio $\sigma/\sigma_{0.2}$ is lower than the lower limit noted above, the dent-resistance load under the conditions of 2%P0.1, 4%P0.1, 8%P0.1 is as high as 160 to 210N as shown in FIGS. 8 to 10. For measuring the dent-resistance load, a steel sheet is shaped into a model panel shown in FIG. 1 with strain of 2%, 4% or 8% imparted to the steel sheet, followed by applying a heat treatment at 170° C. for 20 minutes. Then, measured is a load required for imparting a residual displacement of 0.1 mm to the model panel. However, the spring back $\delta$ (measured for a panel having a strain of 2%) is as large as 7 to 11% so as to impair the panel shapeability, if the ratio $\sigma/\sigma_{0.2}$ is lower than the lower limit noted above. On the other hand, if the ratio $\sigma/\sigma_{0.2}$ is higher than the upper limit noted above, the spring back $\delta$ is as small as 1 to 5%. However, the dent-resistance is as low as 140 to 165N. In other words, the dent-resistance cannot be improved.

A cold-rolled steel sheet and a galvanizing steel sheet excellent in the panel surface properties, the resistance to natural aging and the dent-resistance required for the steel used for an outer panel of a motor car can be obtained by controlling the additive components as described in item (1) above and the tensile characteristics as described in item (2) above.

The steel sheet exhibiting the particular properties can be manufactured as follows.

(3) Steel Sheet Manufacturing Process

Figure 11:
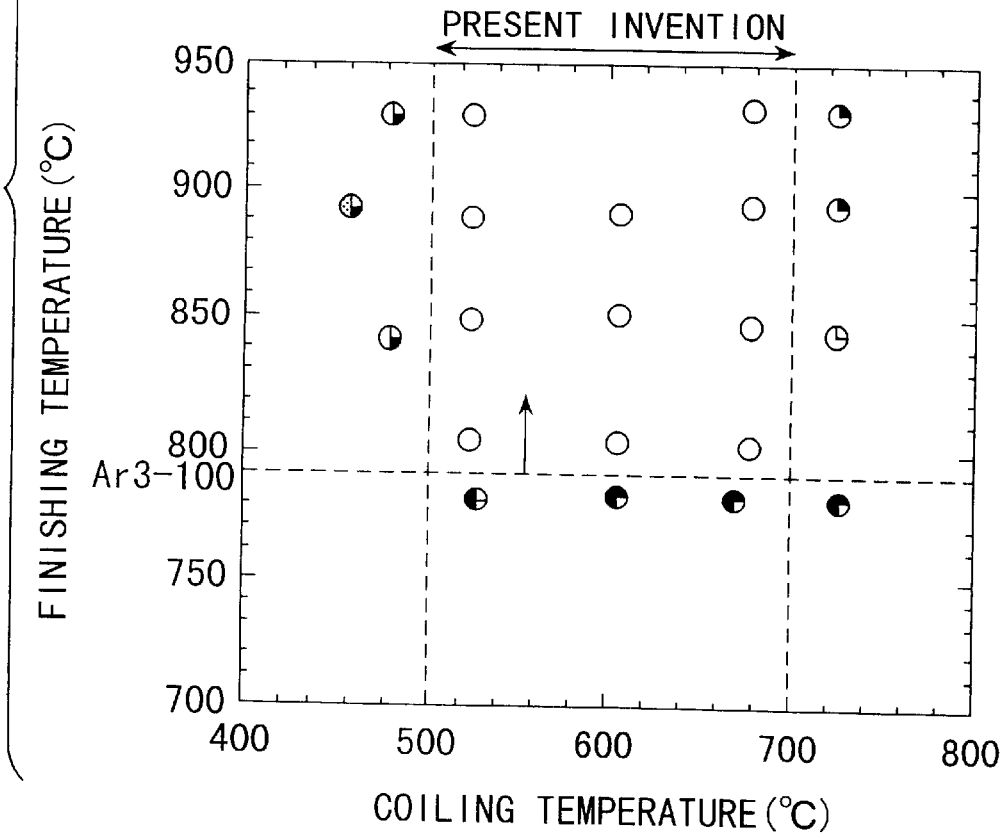
FIG. 11 is a graph showing how the finishing temperature and the coiling temperature have an influence on P0.1 (dent-resistance load of a panel imparted with strains of 2%), $\delta$, and Wca (Arithmetic Average Waviness Height) according to the second embodiment of the present invention.

In the first step, steel of the composition given in item (1) above is melted. A converter method is generally employed for melting the steel composition, or an electric furnace method can also be employed. After the molten steel is continuously cast to obtain a slab, the slab is heated to 1050° C. or higher immediately after the casting, or after the slab is once cooled, for applying a hot rolling. The hot rolling is performed under the conditions that the finishing temperature is set at temperature not less than $(Ar_3-100)$° C. and that the coiling temperature is set at 500° C. to 700° C. If the finishing temperature is lower than $(Ar_3-100)$° C., 2%P0.1, i.e., the dent-resistance load of the panel imparted with 2% of strain) is as low as 140 to 155N, as shown in FIG. 11. In other words, the dent-resistance of the panel cannot be improved. Also, where the coiling temperature is lower than 500° C. or higher than 700° C., the value of 2%P0.1 is high, i.e., 156 to 175N. However, the value of Wca, (i.e., Arithmetic Average Waviness Height;, measuring length of 25 mm; average of the values measured at 10 optional points around the apex of the panel) is large, which falls within a range of between a value exceeding 0.2 μm and 0.6 μm, leading to a poor panel shapeability.

In the next step, the hot-rolled steel band is subjected to a pickling, cold-rolling and, then, a continuous annealing. Alternatively, galvanizing is applied after the continuous annealing step. The cold-rolling reduction should desirably be at least 70% in order to improve the deep drawability of the steel sheet. The annealing should desirably be carried out within a recrystallization temperature region of the ferrite phase and not higher than 930° C. Further, the coating employed in the present invention is not limited to galvanizing. Specifically, even if a surface treatment such as coating with zinc phosphate or an electrolytic zinc coating is applied to the steel sheet obtained by the continuous annealing, no problem is brought about in the characteristics of the resultant steel sheet.

Some Examples of the present invention will now be described to demonstrate the prominent effects produced by the present invention.

EXAMPLES

Example 1

Molten steel of the composition shown in Table 1 were prepared in a laboratory, followed by continuously casting the steel to prepare a slab having a thickness of 60 mm. Samples Nos. 1 to 7 shown in Table 1 represent the steel of the composition specified in the present invention, with samples Nos. 8 to 15 denoting the steel for Comparative Examples. The slab was treated by a blooming mill to reduce the thickness of the steel sheet to 30 mm, followed by heating the steel sheet at 1050° C. for 1.5 hours under the atmosphere for the hot rolling treatment (by roughing mill). After the rough rolling, a finish rolling was applied at 900° C., followed by applying a coiling simulation at 630° C. so as to obtain a hot rolled sheet having a thickness of 3 mm. Then, the hot rolled steel sheet was pickled, followed by applying a cold rolling to reduce the thickness of the steel sheet to 0.8 mm and subsequently applying a continuous annealing at 840° C. for 90 seconds. Alternatively, after the continuous annealing at 840° C. for 90 seconds, a galvanizing was applied at 460° C., followed by applying an alloying treatment at 530° C. Further, 1.0% of temper rolling was applied to the annealed steel sheet or the galvanized steel sheet so as to prepare samples for the experiments. These samples were used for the tensile test (test piece of JIS No. 5; tested in accordance with the method specified in JIS Z 2241) and for measuring the r-value, 2% BH amount (measured in accordance with the method specified in JIS G 3135), and ΔYPel (restoring amount of yield point elongation of the sample stored at 25° C. for 6 months after the temper rolling). Also, the sample was formed into the model panel shown in FIG. 2 (formed at three levels of the forming strain of 2, 4 and 8%). After a heat treatment was applied at 170° C. for 20 minutes, the dent-resistance of the panel and the shapeability of the panel were examined. The dent-resistance was evaluated under a load of P0.1, in which 0.1 mm of residual displacement was imparted to the panel (in the following description, expressions of 2%P0.1, 4%P0.1 and 8%P0.1 are used for denoting the panel imparted with strain of 2, 4 and 8%, respectively). On the other hand, the panel shapeability was evaluated by the spring back amount δ and Wca: Arithmetic Average Waviness Height (JIS B 0610). The spring back amount δ was defined by using a curvature radius R' of the panel imparted with 2% of strain and a curvature radius R of the press mold, i.e., δ was defined by (R'/R—1)×100. Where δ was not larger than 6%, i.e., δ>6%, the evaluation was marked by ○. Where δ was 7 to 10%, i.e., δ=7 to 10%, the evaluation was marked by Δ. Further, where δ was larger than 10%, i.e., δ>10%, the evaluation was marked by x. On the other hand, the surface waviness height each having a length of 25 mm were measured at optional 10 points in the vicinity of the apex of the panel, and the average measured value is denoted by Wca. Where Wca was not larger than 0.2 μm, i.e., Wca≦0.2 μm, the evaluation was marked by ○. Where Wca was larger than 0.2 μm but not larger than 0.4 μm, i.e., 0.2 μm<Wca≦0.4 μm, the evaluation was marked by Δ. Further, where Wca was larger than 0.4 μm and not larger than 0.6 μm, i.e., 0.4 μm<Wca≦0.6 μm, the evaluation was marked by x.

Table 2 shows the results of measurements and evaluations. In samples Nos. 1 to 7 each having a composition falling within the range specified in the present invention, the value of the elongation El was as large as 41.6% to 45.0%. The average r-value, i.e., (r0+2r45+r90)/4, was as large as 1.80 to 2.20. The value of ΔYPel was 0% in any of the samples of the present invention. On the other hand, the spring back amount δ and the Waviness Height Wca were small, i.e., 3% to 5% and 0.09 μm to 0.17 μm, respectively, supporting a good panel shapeability. Further, the dent-resistance P0.1 of the panel imparted with strains of 2%, 4% and 8% was as high as 158N to 193N.

On the other hand, the steel samples Nos. 8 to 15, each having a composition failing to fall within the range specified in the present invention, did not satisfy simultaneously the formability, the shapeability, and the dent-resistance. Specifically, each of Comparative Samples Nos. 8 and 9 exhibited a 2% BH as high as 33 MPa to 42 MPa and a ΔYPel of 0.9% to 2.2%, indicating that these samples were not satisfactory in the resistance to natural aging. Also, the dent-resistance P0.1 under strains of 2% to 8% was found to be 165N to 193N, supporting a high dent-resistance. However, each of these Comparative samples was low in each of the elongation El and the r-value and large in each of the spring back amount δ and the value of Wca, supporting that these Comparative samples were not satisfactory in formability and shapeability. Comparative steel sample No. 10 was high in the elongation El and the r-value, and low in δ and Wca, supporting that this sample was satisfactory in each of formability and shapeability. However, the dent-resistance load P0.1 under strains of 2% to 8% was as low as 148 to 172N. Comparative steel sample No. 11 was high in $\sigma_{0.2}$, which was 265 MPa to 270 MPa, supporting that this sample was satisfactory in dent-resistance. However, the steel sample was high in each of δ and Wca, supporting a poor panel shape. Further, this steel sample was low in the elongation El and the r-value. Each of Comparative steel samples Nos. 12 and 13 was high in the r-value, which was 2.02 to 2.20, but low in El, which was 35.8% to 36.8%. Also, these steel samples were somewhat high in $\sigma_{0.2}$, which was 240 MPa to 250 MPa, supporting a satisfactory dent-resistance. However, since the values of δ and Wca were large, the panel shape of each of these Comparative steel samples was not satisfactory. Further, each of Comparative steel samples Nos. 14 and 15 was low in El, which was 37.0 to 38.5%, and in the r-value, which was 1.51 to 1.69, supporting a poor shapeability.

TABLE 1

| Steel Sample No. | C | Si | Mn | P | S | sol.Al | N | Nb | B | O | (12/93)* (Nb/C) | Remarks |
|---|---|---|---|---|---|---|---|---|---|---|---|---|
| 1 | 0.0067 | 0.02 | 0.30 | 0.040 | 0.008 | 0.060 | 0.0022 | 0.062 | tr. | 0.0020 | 1.2 | Present invention |
| 2 | 0.0080 | 0.06 | 0.65 | 0.020 | 0.012 | 0.035 | 0.0030 | 0.081 | tr. | 0.0024 | 1.3 | Present invention |
| 3 | 0.0085 | 0.14 | 0.55 | 0.050 | 0.01 | 0.059 | 0.0020 | 0.145 | tr. | 0.0022 | 2.2 | Present invention |
| 4 | 0.013 | 0.07 | 1.20 | 0.020 | 0.009 | 0.070 | 0.0035 | 0.141 | tr. | 0.0017 | 1.4 | Present invention |
| 5 | 0.010 | 0.13 | 0.90 | 0.055 | 0.011 | 0.062 | 0.0018 | 0.202 | tr. | 0.0019 | 2.6 | Present invention |
| 6 | 0.0072 | 0.02 | 0.80 | 0.025 | 0.01 | 0.040 | 0.0025 | 0.073 | 0.0003 | 0.0025 | 1.3 | Present invention |
| 7 | 0.011 | 0.04 | 0.60 | 0.040 | 0.013 | 0.030 | 0.0019 | 0.119 | 0.0008 | 0.0020 | 1.4 | Present invention |
| 8 | 0.0045* | 0.05 | 0.65 | 0.055 | 0.01 | 0.063 | 0.0025 | 0.024 | tr. | 0.0019 | 0.7* | Comparative example |
| 9 | 0.0081 | 0.03 | 0.45 | 0.064 | 0.0075 | 0.055 | 0.0022 | 0.050 | tr. | 0.0025 | 0.8* | Comparative example |
| 10 | 0.0033* | 0.05 | 0.55 | 0.035 | 0.007 | 0.059 | 0.0025 | 0.038* | tr. | 0.0023 | 1.5 | Comparative example |
| 11 | 0.019* | 0.10 | 0.75 | 0.060 | 0.012 | 0.070 | 0.0030 | 0.191 | tr. | 0.0022 | 1.3 | Comparative example |
| 12 | 0.0076 | 0.06 | 0.52 | 0.042 | 0.009 | 0.040 | 0.0025 | 0.200 | tr. | 0.0017 | 3.4* | Comparative example |
| 13 | 0.010 | 0.05 | 0.80 | 0.039 | 0.01 | 0.040 | 0.0024 | 0.270* | tr. | 0.0018 | 3.5* | Comparative example |
| 14 | 0.0070 | 0.04 | 0.59 | 0.015 | 0.008 | 0.037 | 0.0032 | 0.081 | tr. | 0.0036* | 1.5 | Comparative example |
| 15 | 0.010 | 0.05 | 0.80 | 0.040 | 0.01 | 0.038 | 0.0024 | 0.100 | tr. | 0.0043* | 1.3 | Comparative example |

*outside scope of present invention

TABLE 2

| Steel sample No. | Annealing method | σ0.2 (MPa) | TS (MPa) | El (%) | Average r-value | 2% BH (MPa) | ΔYPel (%) | σ(ε = 0.02) (MPa) | σ(ε = 0.04) (MPa) |
|---|---|---|---|---|---|---|---|---|---|
| 1 | CA | 225 | 373 | 42.5 | 1.88 | 0 | 0 | 283 | 318 |
| | CG | 227 | 370 | 42.0 | 1.85 | 0 | 0 | 286 | 322 |
| 2 | CA | 229 | 377 | 43.0 | 1.95 | 0 | 0 | 289 | 324 |
| | CG | 230 | 375 | 42.6 | 1.92 | 0 | 0 | 289 | 324 |
| 3 | CA | 235 | 388 | 45.0 | 2.20 | 0 | 0 | 294 | 328 |
| | CG | 232 | 390 | 44.6 | 2.10 | 0 | 0 | 294 | 327 |
| 4 | CA | 233 | 396 | 42.0 | 1.97 | 0 | 0 | 293 | 328 |
| | CG | 230 | 392 | 41.6 | 1.93 | 0 | 0 | 293 | 323 |
| 5 | CA | 230 | 370 | 42.5 | 2.15 | 0 | 0 | 288 | 321 |
| | CG | 230 | 375 | 42.0 | 2.11 | 0 | 0 | 286 | 320 |
| 6 | CA | 235 | 380 | 42.0 | 2.00 | 0 | 0 | 298 | 328 |
| | CG | 233 | 376 | 41.6 | 1.94 | 0 | 0 | 293 | 324 |
| 7 | CA | 233 | 385 | 43.0 | 1.99 | 0 | 0 | 295 | 323 |
| | CG | 225 | 380 | 42.0 | 1.93 | 0 | 0 | 284 | 316 |
| 8 | CA | 240 | 343 | 41.0 | 1.70 | 35 | 1.0 | 270* | 296* |
| | CG | 245 | 345 | 39.7 | 1.65 | 33 | 0.9 | 276* | 300* |
| 9 | CA | 260 | 399 | 36.5 | 1.55 | 40 | 2.0 | 290* | 315* |
| | CG | 258 | 402 | 35.9 | 1.51 | 42 | 2.2 | 290* | 311* |
| 10 | CA | 213 | 358 | 43.5 | 2.00 | 0 | 0 | 280* | 312* |
| | CG | 210 | 357 | 43.0 | 1.97 | 0 | 0 | 272* | 305* |
| 11 | CA | 270 | 410 | 38.0 | 1.60 | 0 | 0 | 320* | 363* |
| | CG | 265 | 404 | 37.5 | 1.57 | 0 | 0 | 313* | 357* |
| 12 | CA | 244 | 386 | 36.8 | 2.20 | 0 | 0 | 304 | 339 |
| | CG | 240 | 385 | 36.0 | 2.10 | 0 | 0 | 299 | 335 |
| 13 | CA | 247 | 400 | 36.3 | 2.15 | 0 | 0 | 307 | 340 |
| | CG | 250 | 402 | 35.8 | 2.02 | 0 | 0 | 310 | 345 |
| 14 | CA | 228 | 370 | 38.5 | 1.69 | 0 | 0 | 288 | 319 |
| | CG | 225 | 368 | 38.2 | 1.65 | 0 | 0 | 282 | 319 |
| 15 | CA | 255 | 406 | 37.0 | 1.60 | 0 | 0 | 307* | 342* |
| | CG | 258 | 404 | 37.5 | 1.51 | 0 | 0 | 304* | 344* |

| Steel Sample No. | σ(ε = 0.08) (MPa) | 2% PO.1 (N) | 4% PO.1 (N) | 8% PO.1 (N) | δ(%) | Wca (μm) | Remarks |
|---|---|---|---|---|---|---|---|
| 1 | 385 | 158 | 167 | 183 | 3(○) | 0.10(○) | Present invention |
| | 389 | 159 | 168 | 186 | 3(○) | 0.10(○) | Present invention |
| 2 | 387 | 160 | 171 | 186 | 4(○) | 0.10(○) | Present invention |
| | 389 | 160 | 171 | 189 | 4(○) | 0.15(○) | Present invention |
| 3 | 397 | 163 | 173 | 192 | 5(○) | 0.17(○) | Present invention |
| | 392 | 163 | 173 | 190 | 4(○) | 0.14(○) | Present invention |
| 4 | 392 | 163 | 175 | 191 | 3(○) | 0.15(○) | Present invention |
| | 388 | 161 | 170 | 189 | 3(○) | 0.14(○) | Present invention |
| 5 | 390 | 160 | 171 | 190 | 3(○) | 0.10(○) | Present invention |
| | 388 | 160 | 169 | 190 | 3(○) | 0.13(○) | Present invention |
| 6 | 395 | 167 | 175 | 193 | 4(○) | 0.15(○) | Present invention |
| | 392 | 164 | 173 | 189 | 4(○) | 0.12(○) | Present invention |
| 7 | 390 | 164 | 174 | 188 | 4(○) | 0.12(○) | Present invention |
| | 383 | 159 | 168 | 184 | 3(○) | 0.09(○) | Present invention |

TABLE 2-continued

| | | | | | | | |
|---|---|---|---|---|---|---|---|
| 8 | 355* | 166 | 170 | 185 | 7(Δ) | 0.26(Δ) | Comparative example |
| | 361* | 165 | 172 | 188 | 8(Δ) | 0.30(Δ) | Comparative example |
| 9 | 374* | 178 | 190 | 193 | 11(X) | 0.50(X) | Comparative example |
| | 372* | 180 | 187 | 193 | 11(X) | 0.49(X) | Comparative example |
| 10 | 377* | 154 | 160 | 172 | 2(○) | 0.10(○) | Comparative example |
| | 373* | 148 | 157 | 170 | 2(○) | 0.08(○) | Comparative example |
| 11 | 419* | 182 | 197 | 196 | 12(X) | 0.46(X) | Comparative example |
| | 415* | 177 | 195 | 190 | 11(X) | 0.44(X) | Comparative example |
| 12 | 408 | 168 | 177 | 189 | 7(Δ) | 0.25(Δ) | Comparative example |
| | 405 | 166 | 173 | 188 | 7(Δ) | 0.24(Δ) | Comparative example |
| 13 | 416 | 168 | 175 | 191 | 8(Δ) | 0.29(Δ) | Comparative example |
| | 419 | 171 | 181 | 194 | 10(Δ) | 0.29(Δ) | Comparative example |
| 14 | 388 | 161 | 159 | 190 | 3(○) | 0.12(○) | Comparative example |
| | 382 | 158 | 160 | 187 | 3(○) | 0.10(○) | Comparative example |
| 15 | 416* | 166 | 174 | 191 | 11(X) | 0.27(Δ) | Comparative example |
| | 415* | 165 | 177 | 190 | 11(X) | 0.32(Δ) | Comparative example |

*outside scope of formula (1)
CA continuous annealing
CG continuous galvanizing

Example 2

A molten steel having a composition of steel sample No. 2 of the present invention shown in Table 1 was prepared by melting and casting in a laboratory, followed by casting the molten steel to prepare a slab having a thickness of 50 mm. The slab was treated by a blooming mill to reduce the thickness of the steel sheet to 25 mm, followed by heating the steel sheet at 1250° C. for 1 hour under the atmosphere and subsequently applying a hot rolling treatment to reduce the thickness of the steel sheet to 2.8 mm. The finishing temperature and the coiling temperature in the hot rolling treatment were changed within ranges of 770° C. to 930° C. and 450° C. to 750° C., respectively. Then, the hot rolled steel sheet was pickled, followed by applying a cold rolling to reduce the thickness of the steel sheet to 0.75 mm and subsequently applying a soaking treatment at 825° C. for 90 seconds. Further, a temper rolling was applied at an elongation of 1.2%. The mechanical characteristics and the panel characteristics of the thin steel sheet thus prepared were examined as in Example 1. Table 3 shows the results. The finishing temperature for each of steel samples Nos. 1 to 3 of the present invention was lower than ($Ar_3$−100)° C. Also, each of these steel samples exhibited a low P0.1 under strains of 2% to 8%, i.e., 139N to 159N, and a high Wca, i.e., 0.35 μm to 0.40 μm, indicating that these steel samples were poor in the dent-resistance and in the shapeability. Further, the r-value for these steel samples was as low as 1.69 to 1.77. The coiling temperature for each of steel samples Nos. 7 and 12 was lower than 500° C. Also, each of these steel samples exhibited a high $\sigma_{0.2}$ value, i.e., 243 MPa and 248 MPa, respectively, supporting a good dent-resistance. However, the δ value was as high as 8% and the Wca value was as high as 0.30 μm, indicating that these steel samples were poor in the panel shape. The coiling temperature for each of steel samples Nos. 11, 15 and 18 was higher than 700° C. Also, each of these steel samples exhibited a low $\sigma_{0.2}$ value, i.e., 210 MPa to 216 MPa, and such a low δ value of 2%. However, the Wca value was as high as 0.42 μm to 0.43 μm. Also, the dent-resistance load was low in each of these steel samples. On the other hand, each of steel samples Nos. 4–6, 8–10, 13, 14, 16 and 17, which fell within the scopes specified in the present invention in respect of the finishing temperature and the coiling temperature, was found to be satisfactory in each of the formability, the dent-resistance and the shapeability.

TABLE 3

| No. | Steel sample No. | Finish temperature (° C.) | Coiling temperature (° C.) | σ0.2 (MPa) | TS (MPa) | El (%) | Average r-value | σ(ε = 0.02) (MPa) |
|---|---|---|---|---|---|---|---|---|
| 1 | Steel 2 | 770** | 540 | 212 | 375 | 41.3 | 1.73 | 275* |
| 2 | | | 600 | 217 | 372 | 42.0 | 1.69 | 281* |
| 3 | | | 660 | 215 | 370 | 42.0 | 1.77 | 280* |
| 4 | | 810 | 530 | 230 | 380 | 43.0 | 1.89 | 289 |
| 5 | | | 600 | 227 | 375 | 43.5 | 1.92 | 285 |
| 6 | | | 670 | 225 | 377 | 44.0 | 1.95 | 285 |
| 7 | | 850 | 470** | 243 | 382 | 41.0 | 1.80 | 293* |
| 8 | | | 530 | 232 | 377 | 42.8 | 1.88 | 292 |
| 9 | | | 590 | 230 | 370 | 43.3 | 1.93 | 289 |
| 10 | | | 650 | 230 | 373 | 43.0 | 1.95 | 293 |
| 11 | | | 715** | 216 | 370 | 43.3 | 1.82 | 281* |
| 12 | | 890 | 450** | 248 | 382 | 41.2 | 1.82 | 301* |
| 13 | | | 550 | 233 | 371 | 42.8 | 1.90 | 292 |
| 14 | | | 650 | 226 | 378 | 43.5 | 1.98 | 287 |
| 15 | | | 750** | 210 | 367 | 42.7 | 1.83 | 274* |
| 16 | | 930 | 550 | 230 | 370 | 42.8 | 1.91 | 290 |
| 17 | | | 650 | 225 | 375 | 43.2 | 1.95 | 283 |
| 18 | | | 750** | 212 | 368 | 43.7 | 1.81 | 277* |

TABLE 3-continued

| No. | σ(ε = 0.04) (MPa) | σ(ε = 0.08) (MPa) | 2%, 4%, 8% PO.1 (N) | δ (%) | Wca (μm) | Remarks |
|---|---|---|---|---|---|---|
| 1 | 306* | 375* | 139–153 | 2(○) | 0.35(Δ) | Comparative example |
| 2 | 313* | 383* | 143–159 | 2(○) | 0.40(Δ) | Comparative example |
| 3 | 311* | 380* | 144–156 | 2(○) | 0.40(Δ) | Comparative example |
| 4 | 322 | 392 | 152–179 | 4(○) | 0.15(○) | Present invention |
| 5 | 317 | 387 | 150–175 | 4(○) | 0.10(○) | Present invention |
| 6 | 318 | 388 | 150–177 | 3(○) | 0.09(○) | Present invention |
| 7 | 328* | 400* | 155–182 | 8(Δ) | 0.30(Δ) | Comparative example |
| 8 | 324 | 392 | 154–178 | 4(○) | 0.10(○) | Present invention |
| 9 | 320 | 390 | 151–178 | 4(○) | 0.12(○) | Present invention |
| 10 | 322 | 392 | 154–177 | 4(○) | 0.12(○) | Present invention |
| 11 | 313* | 382* | 144–156 | 2(○) | 0.43(X) | Comparative example |
| 12 | 334* | 407* | 160–184 | 8(Δ) | 0.30(Δ) | Comparative example |
| 13 | 325 | 394 | 155–180 | 4(○) | 0.07(○) | Present invention |
| 14 | 321 | 385 | 153–171 | 3(○) | 0.18(○) | Present invention |
| 15 | 305* | 372* | 139–152 | 2(○) | 0.42(X) | Comparative example |
| 16 | 321 | 390 | 152–178 | 4(○) | 0.18(○) | Present invention |
| 17 | 315 | 384 | 150–170 | 3(○) | 0.17(○) | Present invention |
| 18 | 309* | 377* | 142–155 | 2(○) | 0.42(X) | Comparative example |

*outside scope of formula (1);
**outside scope of present invention

Example 3

Figure 7:
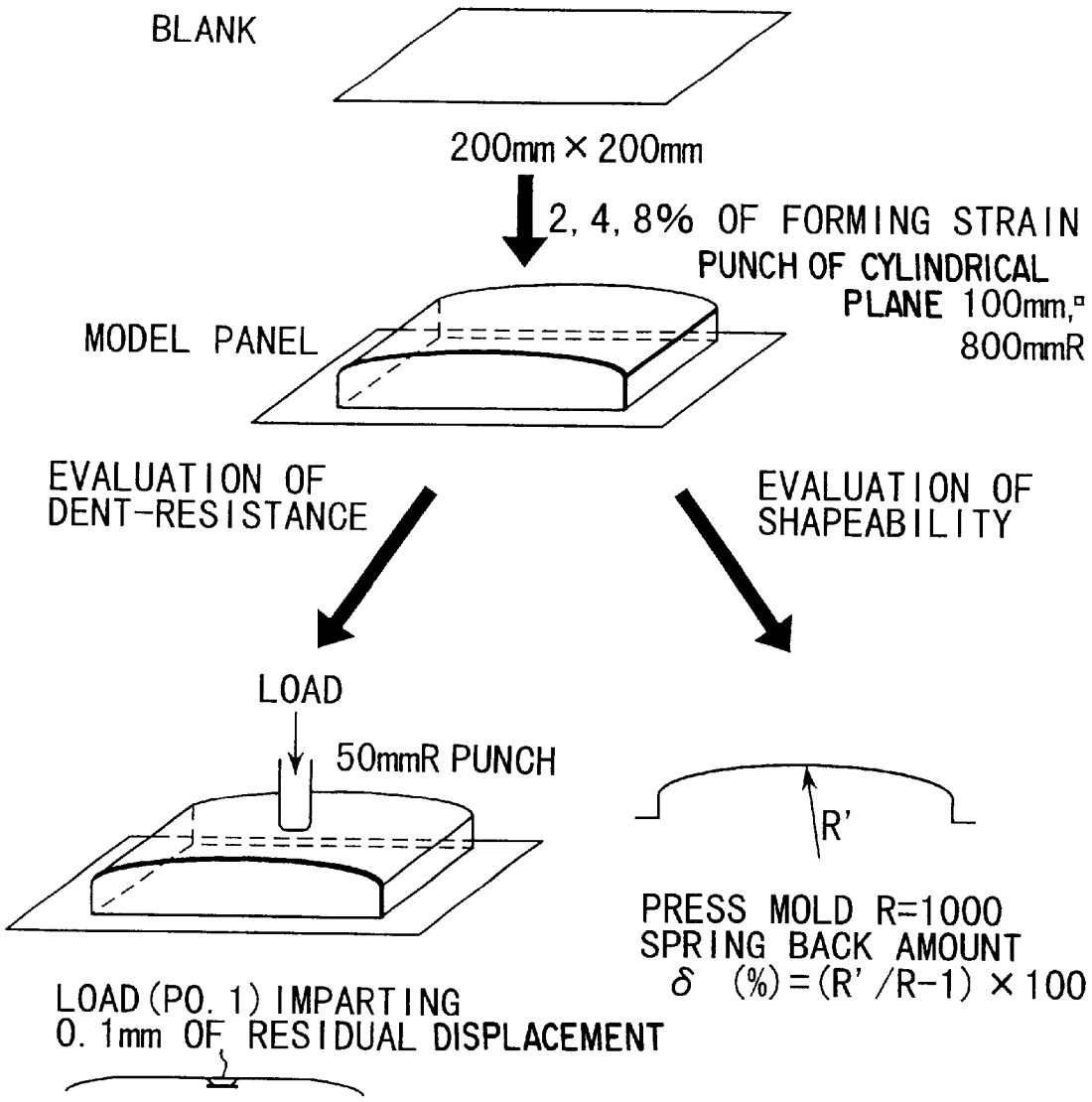
FIG. 7 shows how an experiment for evaluating the dent-resistance and the shapeability is conducted according to a second embodiment of the present invention.

Molten steel of the composition shown in Table 4 (steel samples Nos. 1 to 15 belonging to Examples of the present invention, with steel samples Nos. 16 to 29 belonging to Comparative Example) were prepared in a laboratory, followed by continuously casting the molten steel to prepare a slab having a thickness of 60 mm. The slab was treated by a blooming mill to reduce the thickness of the steel sheet to 30 mm, followed by heating the steel sheet at 1100° C. for 1 hour under the air atmosphere for the hot rolling process (by roughing mill). After the rough rolling, a finish rolling was applied at 890° C., followed by applying a coiling simulation at 600° C. so as to obtain a hot rolled sheet having a thickness of 3 mm. Then, the hot rolled steel sheet was pickled, followed by applying a cold rolling to reduce the thickness of the steel sheet to 0.75 mm and subsequently applying a continuous annealing at 850° C. for 90 seconds. Alternatively, after the continuous annealing at 850° C. for 90 seconds, a galvanizing was applied at 460° C., followed by applying an alloying treatment at 500° C. Further, 1.0% of temper rolling was applied to the annealed steel sheet or the galvanized steel sheet so as to prepare samples for the experiments. These samples were used for the tensile test (test piece of JIS No. 5; tested in accordance with the method specified in JIS Z 2241) and for measuring 2% BH amount (measured in accordance with the method specified in JIS G 3135), and ΔYPel (restoring amount of yield point elongation of the sample stored at 25° C. for 67 months after the temper rolling). Also, the sample was formed into the model panel shown in FIG. 7 (molded at three levels of the strain of 2, 4 and 8%). After a heat treatment was applied at 170° C. for 20 minutes, the dent-resistance of the panel and the shapeability of the panel were examined. The dent-resistance was evaluated under a load of P0.1, in which 0.1 mm of residual displacement was imparted to the panel (in the following description, expressions of 2%P0.1, 4%P0.1 and 8%P0.1 are used for denoting the panel imparted with molding strain of 2, 4 and 8%, respectively). On the other hand, the panel shapeability was evaluated by the spring back amount δ and the Arithmetic Average Waviness Height Wca (JIS B 0610). The spring back amount δ was defined by using a curvature radius R' of the formed panel imparted with 2% of strain and a curvature radius R of the press mold, i.e., δ was defined by (R'/R—1)×100. Where δ was not larger than 6%, i.e., δ≦6%, the evaluation was marked by ○. Where δ was 7 to 10%, i.e., δ=7 to 10%, the evaluation was marked by Δ. Further, where δ was larger than 10%, i.e., δ>10%, the evaluation was marked by x. On the other hand, the surface waviness height each having a length of 25 mm were measured at optional 10 points in the vicinity of the apex of the panel in accordance with the method specified in JIS B 0610, and the average measured value is denoted by Wca. Where Wca was not larger than 0.2 μm, i.e., Wca≦0.2 μm, the evaluation was marked by ○. Where Wca was larger than 0.2 μm but not larger than 0.4 μm, i.e., 0.2 μm<Wca≦0.4 μm, the evaluation was marked by Δ. Further, where Wca was larger than 0.4 μm and not larger than 0.6 μm, i.e., 0.4 μm<Wca≦0.6 μm, the evaluation was marked by x.

Figure 12:
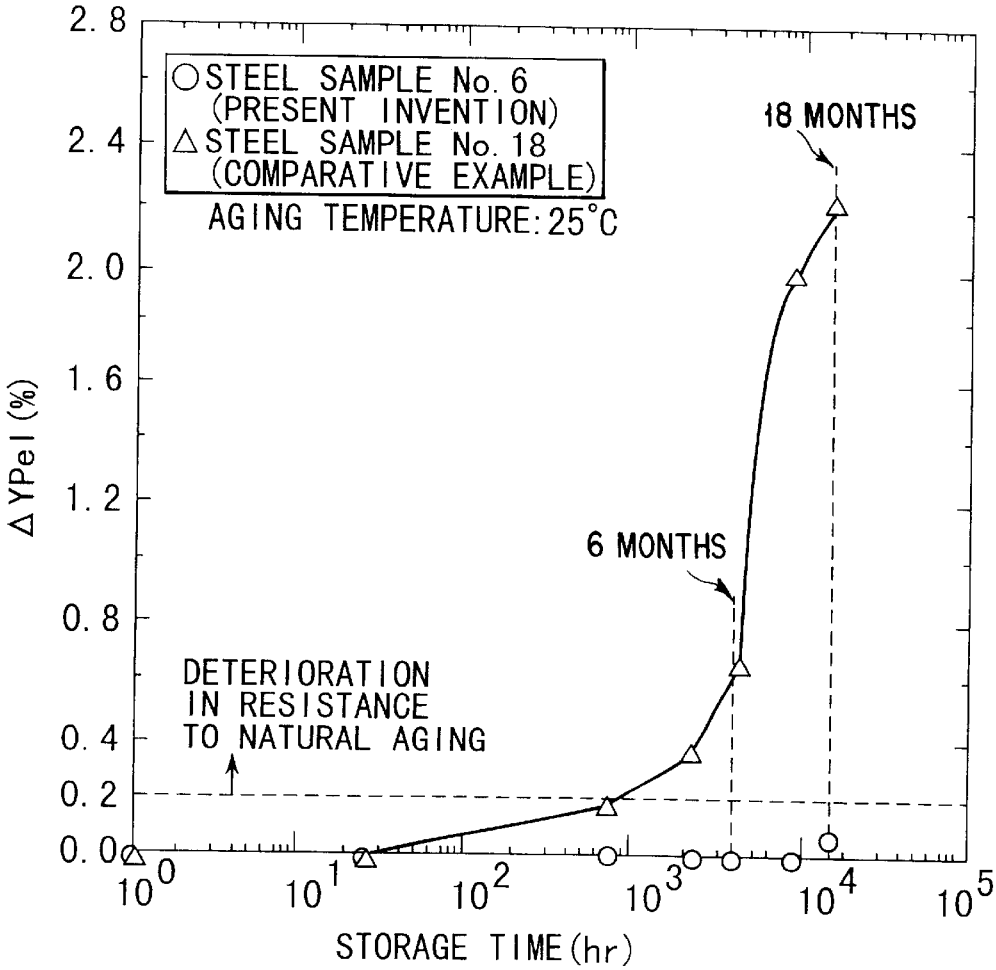
FIG. 12 is a graph showing the relationship between the storage time and $\Delta$YPel (recovery amount of YPel in the case of storage at 25° C. after the temper rolling) in Example 3 of the second embodiment of the present invention.

Table 5 shows the results of measurements and evaluations. In samples Nos. 1 to 15 each having a composition falling within the range specified in the present invention, the value of the 2% BH amount was 0 to 26 MPa and the ΔYPel was 0%. Compared with the steel sample of Comparative Example No. 16, in which the amount of C was 0.0025% and the 2% BH amount was 36 to 38 MPa, 2%P0.1, 4%P0.1, 8%P0.1 of the steel samples of the present invention was high, i.e., 150 to 180N, 160 to 192N and 175 to 208N, supporting a high dent-resistance of the panel. Also, since δ≦6% (evaluation of ○) and Wca<0.2 μm (evaluation of ○), the steel samples of the present invention were satisfactory in the panel shapeability. Further, concerning ΔYPel, the restoring amount of the yield point elongation was measured for the samples (steel sample No. 6 for the present invention and steel sample 18 for Comparative Example) stored for 18 months at 25° C. after the temper rolling, with the results as shown in FIG. 12. The value of ΔYPel after storage for 18 months for the steel sample No. 6 of the present invention was less than 0.2%, supporting an excellent resistance to natural aging. On the other hand, the value of ΔYPel for the steel sample of Comparative Example 18 was 2.2%, supporting a marked deterioration in the resistance to natural aging.

Steel samples for Comparative Examples 16 to 29, which do not fall within the scope defined in the present invention, exhibited large values of 2%P0.1, 4%P0.1 and 8%P0.1 of 140 to 195N, 151 to 202N and 160 to 213N, respectively, supporting a satisfactory dent-resistance of the panel. However, in steel samples of Comparative Examples Nos. 16, 18, 19, 23, 24 and 29, the 2% BH was 33 to 45 MPa, ΔYPel was not smaller than 0.2%, i.e., ΔYPel≧0.2%, and Wca was larger than 0.2 μm, i.e., Wca>0.2%. In other words, these steel samples of Comparative Examples were inferior to the steel samples of the present invention in the resistance to natural aging and in the panel shapeability. Also, the value of ΔYPel was 0% in each of the steel samples for comparative Examples Nos. 17, 20–22 and 25–28, supporting a satisfactory resistance to natural aging. However, the value of δ for these Comparative Examples was not smaller than 7%, i.e., δ≧7%, indicating that these steel samples were satisfactory in the panel shapeability.

TABLE 4

| Steel sample No. | Chemical component (% by weight) | | | | | | | |
|---|---|---|---|---|---|---|---|---|
| | C | Si | Mn | P | S | sol. Al | N | Nb |
| 1 | 0.0044 | 0.015 | 0.31 | 0.04 | 0.007 | 0.06 | 0.0025 | 0.04 |
| 2 | 0.0072 | 0.06 | 0.67 | 0.02 | 0.012 | 0.035 | 0.003 | 0.062 |
| 3 | 0.0088 | 0.14 | 0.55 | 0.05 | 0.009 | 0.059 | 0.0022 | 0.072 |
| 4 | 0.013 | 0.08 | 1 | 0.015 | 0.009 | 0.07 | 0.0035 | 0.097 |
| 5 | 0.01 | 0.17 | 0.9 | 0.055 | 0.011 | 0.062 | 0.004 | 0.077 |
| 6 | 0.0066 | 0.075 | 1.2 | 0.045 | 0.008 | 0.042 | 0.0018 | 0.046 |
| 7 | 0.011 | 0.053 | 0.85 | 0.033 | 0.013 | 0.025 | 0.0027 | 0.08 |
| 8 | 0.0059 | 0.01 | 0.75 | 0.06 | 0.01 | 0.055 | 0.0044 | 0.042 |
| 9 | 0.0071 | 0.065 | 0.8 | 0.045 | 0.011 | 0.059 | 0.0019 | 0.05 |
| 10 | 0.005 | 0.035 | 0.97 | 0.035 | 0.0065 | 0.04 | 0.0027 | tr. |
| 11 | 0.0095 | 0.04 | 0.69 | 0.05 | 0.012 | 0.053 | 0.0032 | tr. |
| 12 | 0.0066 | 0.02 | 1.3 | 0.039 | 0.009 | 0.037 | 0.002 | tr. |
| 13 | 0.0088 | 0.1 | 0.73 | 0.02 | 0.01 | 0.04 | 0.0025 | 0.062 |
| 14 | 0.0055 | 0.062 | 0.52 | 0.03 | 0.008 | 0.051 | 0.0024 | 0.02 |
| 15 | 0.01 | 0.049 | 0.33 | 0.061 | 0.012 | 0.069 | 0.003 | tr. |
| 16 | 0.0025* | 0.05 | 0.65 | 0.055 | 0.01 | 0.063 | 0.0025 | 0.01* |
| 17 | 0.003* | 0.05 | 0.55 | 0.035 | 0.007 | 0.059 | 0.0025 | 0.02 |
| 18 | 0.005 | 0.1 | 0.75 | 0.06 | 0.012 | 0.07 | 0.003 | 0.026 |
| 19 | 0.0085 | 0.08 | 1 | 0.051 | 0.008 | 0.037 | 0.0037 | 0.05 |
| 20 | 0.01 | 0.05 | 0.8 | 0.039 | 0.01 | 0.04 | 0.0024 | 0.1 |
| 21 | 0.019* | 0.03 | 0.45 | 0.064 | 0.0075 | 0.055 | 0.0022 | 0.15* |
| 22 | 0.0055 | 0.07 | 0.7 | 0.05 | 0.01 | 0.049 | 0.003 | 0.027 |
| 23 | 0.011 | 0.055 | 0.59 | 0.04 | 0.01 | 0.045 | 0.002 | 0.056 |
| 24 | 0.006 | 0.1 | 0.73 | 0.046 | 0.0085 | 0.065 | 0.0032 | tr. |
| 25 | 0.02* | 0.065 | 1.2 | 0.035 | 0.011 | 0.052 | 0.0025 | tr. |
| 26 | 0.0049 | 0.1 | 0.82 | 0.05 | 0.007 | 0.056 | 0.0024 | tr.* |
| 27 | 0.009 | 0.045 | 0.85 | 0.05 | 0.01 | 0.07 | 0.0029 | tr.* |
| 28 | 0.0055 | 0.08 | 0.7 | 0.05 | 0.009 | 0.052 | 0.002 | tr.* |
| 29 | 0.009 | 0.04 | 0.5 | 0.038 | 0.01 | 0.059 | 0.0026 | tr.* |

TABLE 4-continued

| Steel sample No. | Chemical component (% by weight) | | | | C-(12/93)Nb-(12/48)Ti* | Remarks |
|---|---|---|---|---|---|---|
| | Ti | Zr | V | B | | |
| 1 | tr. | tr. | tr. | tr. | −0.0008 | Present invention |
| 2 | tr. | tr. | tr. | tr. | −0.0008 | |
| 3 | tr. | tr. | tr. | tr. | −0.0005 | |
| 4 | tr. | tr. | tr. | tr. | 0.0005 | |
| 5 | tr. | tr. | tr. | tr. | 0.0001 | |
| 6 | tr. | tr. | tr. | tr. | 0.0007 | |
| 7 | 0.025 | tr. | tr. | tr. | 0.0007 | |
| 8 | 0.015 | tr. | tr. | tr. | 0.0005 | |
| 9 | 0.027 | tr. | tr. | tr. | −0.0003 | |
| 10 | 0.037 | tr. | tr. | tr. | 0.0005 | |
| 11 | 0.07 | tr. | tr. | tr. | −0.0008 | |
| 12 | 0.045 | tr. | tr. | tr. | 0.0004 | |
| 13 | tr. | tr. | tr. | 0.0003 | 0.0008 | |
| 14 | 0.032 | tr. | tr. | 0.0013 | 0.0000 | |
| 15 | 0.067 | tr. | tr. | 0.0006 | 0.0003 | |
| 16 | tr. | tr. | tr. | tr. | 0.0012* | Comparative Example |
| 17 | tr. | tr. | tr. | tr. | 0.0004 | |
| 18 | tr. | tr. | tr. | tr. | 0.0016* | |
| 19 | tr. | tr. | tr. | tr. | 0.0020* | |
| 20 | tr. | tr. | tr. | tr. | −0.0029* | |
| 21 | tr. | tr. | tr. | tr. | −0.0004 | |
| 22 | 0.041 | tr. | tr. | tr. | −0.0019* | |
| 23 | 0.03 | tr. | tr. | tr. | 0.0017* | |
| 24 | 0.041 | tr. | tr. | tr. | 0.0017* | |
| 25 | 0.12* | tr. | tr. | tr. | −0.0037 | |
| 26 | tr.* | 0.075* | tr. | tr. | —* | |
| 27 | tr.* | 0.11* | tr. | tr. | —* | |
| 28 | tr.* | tr. | 0.025* | tr. | —* | |
| 29 | tr.* | tr. | 0.035* | tr. | —* | |

Note:

mark * represents that the values does not fall within the scope specified in the present invention.

Ti* = Ti % − (48/14)N % − (48/32)S % (where Ti* is not larger than 0, Ti* is regarded as 0)

TABLE 5

(Part 1)

| Steel Sample No. | Annealing | σ 0.2 (MPa) | TS (MPa) | El (%) | 2% BH (MPa) | ΔYPel (%) | σ (ε = 0.2) (MPa) | σ (ε = 0.04) (MPa) | σ (ε = 0.08) (MPa) |
|---|---|---|---|---|---|---|---|---|---|
| 1 | Continuous annealing | 229 | 370 | 41 | 0 | 0 | 285 | 321 | 388 |
| | Continuous galvanizing | 231 | 368 | 40 | 0 | 0 | 287 | 323 | 391 |
| 2 | Continuous annealing | 230 | 375 | 40.5 | 0 | 0 | 290 | 322 | 390 |
| | Continuous galvanizing | 230 | 377 | 39.5 | 0 | 0 | 289 | 325 | 388 |
| 3 | Continuous annealing | 237 | 390 | 39.3 | 0 | 0 | 296 | 331 | 403 |
| | Continuous galvanizing | 235 | 392 | 38.5 | 0 | 0 | 299 | 330 | 400 |
| 4 | Continuous annealing | 230 | 380 | 39.5 | 22 | 0 | 290 | 321 | 389 |
| | Continuous galvanizing | 228 | 383 | 38.6 | 20 | 0 | 290 | 320 | 385 |

TABLE 5-continued

| | | | | | | | | | |
|---|---|---|---|---|---|---|---|---|---|
| 5 | Continuous annealing | 237 | 395 | 39 | 2 | 0 | 299 | 332 | 403 |
| | Continuous galvanizing | 238 | 397 | 38.3 | 4 | 0 | 297 | 330 | 405 |
| 6 | Continuous annealing | 235 | 395 | 39.3 | 24 | 0 | 296 | 328 | 398 |
| | Continuous galvanizing | 237 | 396 | 38.1 | 25 | 0 | 299 | 330 | 396 |
| 7 | Continuous annealing | 235 | 385 | 40.3 | 23 | 0 | 296 | 329 | 397 |
| | Continuous galvanizing | 237 | 385 | 39.1 | 22 | 0 | 300 | 333 | 400 |
| 8 | Continuous annealing | 230 | 392 | 39 | 20 | 0 | 290 | 322 | 389 |
| | Continuous galvanizing | 233 | 393 | 38 | 20 | 0 | 295 | 325 | 392 |
| 9 | Continuous annealing | 235 | 387 | 39.5 | 0 | 0 | 296 | 329 | 397 |
| | Continuous galvanizing | 237 | 385 | 38.3 | 0 | 0 | 300 | 330 | 400 |
| 10 | Continuous annealing | 232 | 381 | 40 | 18 | 0 | 292 | 323 | 392 |
| | Continuous galvanizing | 235 | 384 | 38.5 | 19 | 0 | 295 | 328 | 399 |

| Steel Sample No. | 2% P0.1 (N) | 4% P0.1 (N) | 8% P0.1 (N) | δ (%) | Wca (μm) | Remarks |
|---|---|---|---|---|---|---|
| 1 | 150 | 160 | 175 | 4 (○) | 0.1 (○) | Examples of present invention |
| | 150 | 162 | 177 | 4 (○) | 0.11 (○) | |
| 2 | 153 | 162 | 177 | 4 (○) | 0.1 (○) | |
| | 152 | 163 | 175 | 4 (○) | 0.13 (○) | |
| 3 | 156 | 166 | 186 | 5 (○) | 0.1 (○) | |
| | 159 | 165 | 183 | 5 (○) | 0.1 (○) | |
| 4 | 165 | 177 | 193 | 3 (○) | 0.15 (○) | |
| | 162 | 170 | 188 | 3 (○) | 0.14 (○) | |
| 5 | 160 | 167 | 188 | 5 (○) | 0.09 (○) | |
| | 160 | 167 | 190 | 5 (○) | 0.13 (○) | |
| 6 | 176 | 186 | 205 | 4 (○) | 0.15 (○) | |
| | 180 | 188 | 205 | 4 (○) | 0.16 (○) | |
| 7 | 175 | 186 | 203 | 4 (○) | 0.17 (○) | |
| | 178 | 188 | 205 | 4 (○) | 0.15 (○) | |
| 8 | 163 | 175 | 190 | 3 (○) | 0.15 (○) | |
| | 170 | 179 | 195 | 4 (○) | 0.15 (○) | |
| 9 | 156 | 163 | 181 | 4 (○) | 0.08 (○) | |
| | 159 | 165 | 183 | 4 (○) | 0.12 (○) | |
| 10 | 163 | 173 | 191 | 3 (○) | 0.1 (○) | |
| | 169 | 181 | 200 | 4 (○) | 0.08 (○) | |

(Part 2)

| Steel Sample No. | Annealing | σ 0.2 (MPa) | TS (MPa) | El (%) | 2% BH (MPa) | ΔYPel (%) | σ (ε = 0.2) (MPa) | σ (ε = 0.04) (MPa) | σ (ε = 0.08) (MPa) |
|---|---|---|---|---|---|---|---|---|---|
| 11 | Continuous annealing | 237 | 395 | 39.3 | 0 | 0 | 298 | 331 | 401 |
| | Continuous galvanizing | 236 | 394 | 38.4 | 0 | 0 | 296 | 330 | 398 |
| 12 | Continuous annealing | 235 | 387 | 40 | 17 | 0 | 296 | 330 | 397 |
| | Continuous galvanizing | 236 | 389 | 39.8 | 18 | 0 | 300 | 330 | 400 |
| 13 | Continuous annealing | 237 | 378 | 40 | 26 | 0 | 297 | 333 | 401 |
| | Continuous galvanizing | 235 | 380 | 39.5 | 24 | 0 | 293 | 330 | 391 |
| 14 | Continuous annealing | 233 | 380 | 41 | 0 | 0 | 296 | 325 | 392 |
| | Continuous galvanizing | 235 | 382 | 40.6 | 0 | 0 | 294 | 330 | 397 |
| 15 | Continuous annealing | 238 | 398 | 39 | 15 | 0 | 303 | 336 | 405 |
| | Continuous galvanizing | 237 | 395 | 38.2 | 16 | 0 | 303 | 331 | 402 |

TABLE 5-continued

| | | | | | | | | | |
|---|---|---|---|---|---|---|---|---|---|
| 16 | Continuous annealing | 236 | 355 | 43 | 36* | 0.6* | 268* | 293* | 352* |
| | Continuous galvanizing | 235 | 356 | 42 | 38* | 0.5* | 267* | 291* | 351* |
| 17 | Continuous annealing | 242 | 368 | 41.5 | 15 | 0 | 267* | 295* | 357* |
| | Continuous galvanizing | 244 | 370 | 40 | 13 | 0 | 273* | 310* | 366* |
| 18 | Continuous annealing | 245 | 390 | 39 | 37* | 0.7* | 294* | 318* | 385* |
| | Continuous galvanizing | 245 | 393 | 38 | 39* | 0.6* | 295* | 318* | 388* |
| 19 | Continuous annealing | 258 | 400 | 38.2 | 44* | 2* | 310* | 343* | 405* |
| | Continuous galvanizing | 255 | 403 | 37 | 45* | 1.8* | 308* | 337* | 409* |
| 20 | Continuous annealing | 256 | 408 | 38 | 0 | 0 | 310* | 345* | 417* |
| | Continuous galvanizing | 260 | 405 | 37.2 | 0 | 0 | 315* | 344* | 413* |

| Steel Sample No. | 2% P0.1 (N) | 4% P0.1 (N) | 8% P0.1 (N) | δ (%) | Wca (μm) | Remarks |
|---|---|---|---|---|---|---|
| 11 | 158 | 166 | 185 | 6 (○) | 0.13 (○) | Examples of present invention |
| | 156 | 165 | 181 | 5 (○) | 0.1 (○) | |
| 12 | 168 | 181 | 197 | 5 (○) | 0.15 (○) | |
| | 173 | 183 | 200 | 5 (○) | 0.14 (○) | |
| 13 | 179 | 192 | 208 | 6 (○) | 0.17 (○) | |
| | 172 | 187 | 199 | 5 (○) | 0.18 (○) | |
| 14 | 156 | 163 | 178 | 4 (○) | 0.12 (○) | |
| | 155 | 165 | 181 | 5 (○) | 0.1 (○) | |
| 15 | 173 | 185 | 203 | 6 (○) | 0.15 (○) | |
| | 175 | 181 | 200 | 6 (○) | 0.15 (○) | |
| 16 | 160 | 165 | 177 | 5 (○) | 0.26 (Δ) | Comparative Examples |
| | 161 | 165 | 179 | 5 (○) | 0.25 (Δ) | |
| 17 | 140 | 151 | 165 | 8 (Δ) | 0.15 (○) | |
| | 142 | 152 | 160 | 8 (Δ) | 0.16 (○) | |
| 18 | 183 | 188 | 205 | 9 (Δ) | 0.25 (Δ) | |
| | 185 | 190 | 208 | 10 (Δ) | 0.26 (Δ) | |
| 19 | 193 | 202 | 210 | 13 (X) | 0.39 (Δ) | |
| | 195 | 200 | 212 | 12 (X) | 0.42 (X) | |
| 20 | 163 | 179 | 199 | 12 (X) | 0.19 (○) | |
| | 170 | 178 | 195 | 14 (X) | 0.25 (Δ) | |

(Part 3)

| Steel Sample No. | Annealing | σ 0.2 (MPa) | TS (MPa) | El (%) | 2% BH (MPa) | ΔYPel (%) | σ (ε = 0.2) (MPa) | σ (ε = 0.04) (MPa) | σ (ε = 0.08) (MPa) |
|---|---|---|---|---|---|---|---|---|---|
| 21 | Continuous annealing | 268 | 410 | 38 | 0 | 0 | 320* | 363* | 421* |
| | Continuous galvanizing | 260 | 415 | 37 | 0 | 0 | 310* | 345* | 409* |
| 22 | Continuous annealing | 256 | 391 | 39 | 0 | 0 | 308* | 344* | 410* |
| | Continuous galvanizing | 251 | 393 | 40 | 0 | 0 | 303* | 332* | 400* |
| 23 | Continuous annealing | 261 | 400 | 38.4 | 40* | 0.8* | 308* | 347* | 415* |
| | Continuous galvanizing | 263 | 403 | 37.2 | 37* | 1.2* | 310* | 343* | 420* |
| 24 | Continuous annealing | 257 | 394 | 39 | 40* | 0.6* | 309* | 347* | 415* |
| | Continuous galvanizing | 262 | 391 | 38.2 | 37* | 1* | 312* | 343* | 416* |
| 25 | Continuous annealing | 265 | 398 | 38.3 | 0 | 0 | 312* | 350* | 416* |
| | Continuous galvanizing | 268 | 403 | 37.1 | 0 | 0 | 319* | 315* | 422* |
| 26 | Continuous annealing | 258 | 393 | 38.7 | 0 | 0 | 308* | 340* | 407* |
| | Continuous galvanizing | 258 | 390 | 37 | 0 | 0 | 308* | 341* | 410* |

TABLE 5-continued

| | | | | | | | | | |
|---|---|---|---|---|---|---|---|---|---|
| 27 | Continuous annealing | 265 | 400 | 38.3 | 22 | 0 | 313* | 345* | 412* |
| | Continuous galvanizing | 268 | 403 | 37.1 | 20 | 0 | 320* | 350* | 420* |
| 28 | Continuous annealing | 237 | 399 | 39.3 | 18 | 0 | 310* | 345* | 419* |
| | Continuous galvanizing | 239 | 400 | 38 | 15 | 0 | 315* | 345* | 422* |
| 29 | Continuous annealing | 258 | 388 | 38.5 | 35* | 0.4* | 304* | 347* | 403* |
| | Continuous galvanizing | 260 | 391 | 37.1 | 33* | 0.7* | 308* | 343* | 407* |

| Steel Sample No. | 2% P0.1 (N) | 4% P0.1 (N) | 8% P0.1 (N) | δ (%) | Wca (μm) | Remarks |
|---|---|---|---|---|---|---|
| 21 | 176 | 193 | 194 | 14 (X) | 0.42 (X) | Comparative Examples |
| | 163 | 180 | 190 | 14 (X) | 0.4 (Δ) | |
| 22 | 162 | 178 | 191 | 12 (X) | 0.25 (Δ) | |
| | 160 | 167 | 183 | 12 (X) | 0.27 (Δ) | |
| 23 | 188 | 202 | 212 | 13 (X) | 0.49 (X) | |
| | 186 | 199 | 213 | 13 (X) | 0.44 (X) | |
| 24 | 190 | 202 | 212 | 12 (X) | 0.23 (Δ) | |
| | 188 | 199 | 211 | 13 (X) | 0.25 (Δ) | |
| 25 | 163 | 184 | 200 | 13 (X) | 0.43 (X) | |
| | 175 | 185 | 205 | 14 (X) | 0.45 (X) | |
| 26 | 162 | 170 | 189 | 11 (X) | 0.36 (Δ) | |
| | 162 | 173 | 190 | 13 (X) | 0.35 (Δ) | |
| 27 | 185 | 195 | 208 | 13 (X) | 0.4 (Δ) | |
| | 185 | 197 | 208 | 14 (X) | 0.52 (X) | |
| 28 | 181 | 193 | 207 | 7 (Δ) | 0.59 (X) | |
| | 183 | 192 | 207 | 8 (Δ) | 0.55 (X) | |
| 29 | 184 | 200 | 206 | 12 (X) | 0.44 (X) | |
| | 185 | 198 | 208 | 13 (X) | 0.53 (X) | |

Note:
The mark * represents that the values do not fall within the scopes defined in the present invention.

Example 4

Molten steel having compositions of steel samples Nos. 2 and 14 of the present invention shown in Table 4 was prepared by melting and casting in a laboratory, followed by casting the steel to prepare a slab having a thickness of 50 mm. The slab was treated by a blooming mill to reduce the thickness of the steel sheet to 20 mm, followed by heating the steel sheet at 1200° C. for 1 hour under the atmosphere and subsequently applying a hot rolling treatment to reduce the thickness of the steel sheet to 2.8 mm. The finishing temperature and the coiling temperature in the hot rolling treatment were changed within ranges of 750° C. to 930° C. and 440° C. to 750° C., respectively. Then, the hot rolled steel sheet was pickled, followed by applying a cold rolling to reduce the thickness of the steel sheet to 0.75 mm and subsequently applying a continuous annealing (soaking treatment) at 800° C. for 90 seconds. Further, a temper rolling (1.4%) was applied. The thin steel sheet thus prepared was shaped into a model panel shown in FIG. 7 with equivalent strains of 2%, 4% and 8%, followed by applying a heat treatment at 170° C. for 20 minutes, said heat treatment corresponding to the coating-baking treatment. Table 6 shows the results of evaluation of the dent-resistance of the panel (three levels of 2%, 4% and 8% of strains) and of the shapeability of the panel imparted with 2% of strain. Samples Nos. 4–7, 9–12, 15–18, 20, 21, 27–29, 32–34, and 36–39 shown in Table 6 fall within the scope of the present invention. On the other hand, samples Nos. 1–3, 8, 13, 14, 19, 22–26, 30, 31, 35 and 40 represent Comparative Examples.

The finishing temperature for samples Nos. 1–3 and 23–26 for Comparative Examples was lower than ($Ar_3$–100)° C., which does not fall within the scope defined in the present invention. As a result, these samples for Comparative Examples exhibited a 2% to 8%P0.1 of 140N to 158N and 140N to 165N, and Wca values of 0.38 to 0.43 μm and 0.37 to 0.59 μm, respectively, resulting in failure to obtain a good dent-resistance of the panel and a good shapeability. The coiling temperature for samples Nos. 8, 14, 31, and 35 for Comparative Examples was lower than 500° C. and, thus, each of these samples exhibited a good dent-resistance, i.e., 2 to 8%P0.1 of 160N to 189N. However, the Wca values were 0.23 to 0.45 μm and the δ values were 7 to 8%, indicating a poor panel shapeability.

Further, the coiling temperature for samples Nos. 13, 19, 22, 30, and 40 for Comparative Examples was higher than 700° C. and, thus, each of these samples exhibited an undesirable dent-resistance, i.e., 2 to 8%P0.1 of 145N to 166N. Also, the Wca values were 0.33 to 0.42 μm, indicating a poor panel shapeability.

On the other hand, each of the finishing temperature and the coiling temperature for Nos. 4–7, 9–12, 15–18, 20, 21, 27–29, 32–34, and 36–39 of the present invention fell within the scope defined in the present invention. As a result, 2 to 8%P0.1 was 153 to 188N, supporting a good dent-resistance of the panel. The samples of the present invention were also satisfactory in the δ value, i.e., δ≦5%, and in the Wca value, i.e., Wca<0.2 μm, supporting a good shapeability.

TABLE 6

| Condition No. | Steel sample No. | Finishing temperature (° C.) | Coiling temperature (° C.) | σ 0.2 (MPa) | σ (ε = 0.02) (MPa) | σ (ε = 0.04) (MPa) |
|---|---|---|---|---|---|---|
| 1 | Steel 2 | 780* | 550 | 215 | 283* | 313* |
| 2 | | | 600 | 218 | 284* | 315* |
| 3 | | | 660 | 217 | 282* | 318* |
| 4 | | 820 | 530 | 230 | 294 | 325 |
| 5 | | | 590 | 230 | 291 | 325 |
| 6 | | | 630 | 235 | 294 | 328 |
| 7 | | | 680 | 233 | 294 | 326 |
| 8 | | 860 | 460* | 245 | 299* | 331* |
| 9 | | | 550 | 231 | 295 | 328 |
| 10 | | | 600 | 233 | 294 | 327 |
| 11 | | | 640 | 235 | 296 | 330 |
| 12 | | | 680 | 230 | 294 | 328 |
| 13 | | | 730* | 220 | 285* | 318* |
| 14 | | 900 | 450* | 249 | 303* | 337* |
| 15 | | | 540 | 235 | 298 | 330 |
| 16 | | | 600 | 232 | 296 | 328 |
| 17 | | | 650 | 235 | 299 | 330 |
| 18 | | | 680 | 230 | 295 | 330 |
| 19 | | | 725* | 217 | 283* | 316* |
| 20 | | 930 | 550 | 235 | 295 | 331 |
| 21 | | | 680 | 233 | 295 | 330 |
| 22 | | | 750* | 220 | 285* | 318* |

| Condition No. | σ (ε = 0.08) (MPa) | 2%, 4%, 8% P0.1 (N) | δ (%) | Wca (μm) | Remarks |
|---|---|---|---|---|---|
| 1 | 379* | 140–155 | 3 (○) | 0.38 (Δ) | Comparative example |
| 2 | 384* | 144–155 | 2 (○) | 0.4 (Δ) | Comparative example |
| 3 | 381* | 144–158 | 5 (○) | 0.43 (X) | Comparative example |
| 4 | 390 | 155–177 | 4 (○) | 0.12 (○) | Present invention |
| 5 | 387 | 153–175 | 4 (○) | 0.1 (○) | Present invention |
| 6 | 394 | 155–177 | 4 (○) | 0.18 (○) | Present invention |
| 7 | 391 | 155–178 | 5 (○) | 0.16 (○) | Present invention |
| 8 | 390* | 160–176 | 7 (Δ) | 0.23 (Δ) | Comparative example |
| 9 | 392 | 158–179 | 5 (○) | 0.14 (○) | Present invention |
| 10 | 392 | 157–179 | 4 (○) | 0.15 (○) | Present invention |
| 11 | 394 | 158–177 | 5 (○) | 0.08 (○) | Present invention |
| 12 | 391 | 156–178 | 5 (○) | 0.18 (○) | Present invention |
| 13 | 388* | 148–162 | 3 (○) | 0.36 (Δ) | Comparative example |
| 14 | 397* | 161–181 | 8 (Δ) | 0.26 (Δ) | Comparative example |
| 15 | 395 | 158–178 | 4 (○) | 0.18 (○) | Present invention |
| 16 | 390 | 157–177 | 4 (○) | 0.12 (○) | Present invention |
| 17 | 393 | 159–179 | 5 (○) | 0.1 (○) | Present invention |
| 18 | 393 | 158–179 | 5 (○) | 0.12 (○) | Present invention |
| 19 | 385* | 146–166 | 3 (○) | 0.42 (X) | Comparative example |
| 20 | 394 | 158–178 | 4 (○) | 0.15 (○) | Present invention |
| 21 | 394 | 158–179 | 5 (○) | 0.19 (○) | Present invention |
| 22 | 388* | 149–165 | 3 (○) | 0.41 (X) | Comparative example |

| Condition No. | Steel sample No. | Finishing temperature (° C.) | Coiling temperature (° C.) | σ 0.2 (MPa) | σ (ε = 0.02) (MPa) | σ (ε = 0.04) (MPa) |
|---|---|---|---|---|---|---|
| 23 | Steel 14 | 750* | 450* | 214 | 280* | 315* |
| 24 | | | 550 | 217 | 282* | 320* |
| 25 | | | 650 | 217 | 282* | 318* |
| 26 | | | 750* | 215 | 284* | 320* |
| 27 | | 840 | 550 | 238 | 303 | 335 |
| 28 | | | 600 | 235 | 295 | 333 |
| 29 | | | 650 | 235 | 297 | 332 |
| 30 | | | 730* | 220 | 285* | 320* |
| 31 | | 890 | 440* | 247 | 301* | 335* |
| 32 | | | 550 | 235 | 296 | 334 |
| 33 | | | 650 | 237 | 297 | 335 |
| 34 | | | 680 | 237 | 303 | 335 |
| 35 | | 920 | 460* | 250 | 303* | 339* |
| 36 | | | 520 | 236 | 295 | 333 |
| 37 | | | 580 | 233 | 297 | 332 |
| 38 | | | 640 | 235 | 297 | 335 |
| 39 | | | 680 | 231 | 294 | 331 |
| 40 | | | 730* | 219 | 284* | 318* |

TABLE 6-continued

| Condition No. | σ (ε = 0.08) (MPa) | 2%, 4%, 8% P0.1 (N) | δ (%) | Wca (μm) | Remarks |
|---|---|---|---|---|---|
| 23 | 382* | 140–160 | 3 (○) | 0.4 (Δ) | Comparative example |
| 24 | 382* | 145–160 | 3 (○) | 0.37 (Δ) | Comparative example |
| 25 | 385* | 145–165 | 2 (○) | 0.43 (X) | Comparative example |
| 26 | 385* | 147–165 | 2 (○) | 0.59 (X) | Comparative example |
| 27 | 401 | 160–185 | 5 (○) | 0.18 (○) | Present invention |
| 28 | 400 | 156–183 | 5 (○) | 0.15 (○) | Present invention |
| 29 | 405 | 157–188 | 4 (○) | 0.15 (○) | Present invention |
| 30 | 388* | 147–165 | 3 (○) | 0.33 (Δ) | Comparative example |
| 31 | 405* | 160–189 | 8 (Δ) | 0.3 (Δ) | Comparative example |
| 32 | 400 | 157–183 | 5 (○) | 0.19 (○) | Present invention |
| 33 | 401 | 158–185 | 5 (○) | 0.18 (○) | Present invention |
| 34 | 403 | 160–185 | 5 (○) | 0.13 (○) | Present invention |
| 35 | 403* | 160–187 | 7 (Δ) | 0.45 (X) | Comparative example |
| 36 | 401 | 156–185 | 5 (○) | 0.19 (○) | Present invention |
| 37 | 403 | 158–187 | 5 (○) | 0.19 (○) | Present invention |
| 38 | 402 | 157–185 | 5 (○) | 0.17 (○) | Present invention |
| 39 | 397 | 155–181 | 5 (○) | 0.15 (○) | Present invention |
| 40 | 385* | 145–166 | 3 (○) | 0.38 (Δ) | Comparative example |

Note:
The mark * represents that the values do not fall within the scopes defined in the present invention.

INDUSTRIAL APPLICABILITY

As described above, the present invention makes it possible to manufacture stably a cold-rolled steel sheet and a galvanized steel sheet satisfying the dent-resistance of a panel, the surface shapeability and resistance to natural aging and having a tensile strength of 340 MPa or more, which are required for steels used for an outer panel of a motor car, by specifying the steel composition, the tensile characteristics and the manufacturing conditions. It follows that the present invention is highly valuable in the steel industries and in the motor car industries.

What is claimed is:

1. A cold-rolled steel sheet excellent in formability, panel shapeability and dent-resistance, consisting essentially of 0.005 to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, not higher than 0.004% by weight of N, not higher than 0.003% by weight of O, 0.04 to 0.23% by weight of Nb, the amounts of Nb and C meeting the relationship given in formula (1), and a balance of Fe and unavoidable impurities, said cold-rolled steel sheet meeting the relationship given in formula (2):

$$1.0<(\text{Nb }\%\times 12)/(\text{C }\%\times 93)\leqq 3.0 \quad (1)$$

$$\exp(\epsilon)\times(5.29\times\exp(\epsilon)-4.19)\leqq\sigma/\sigma_{0.2}\leqq\exp(\epsilon)\times(5.64\times\exp(\epsilon)-4.49) \quad (2)$$

where $0.002<\epsilon\leqq 0.096$, $\epsilon$ represents a true strain, $\sigma_{0.2}$ represents a 0.2% proof stress, and $\sigma$ represents a true stress relative to $\epsilon$.

2. The cold-rolled steel sheet excellent in formability, panel shapeability and dent-resistance according to claim 1, further comprising 0.0001 to 0.002% by weight of B.

3. A steel sheet coated with a molten zinc excellent in formability, panel shapeability and dent-resistance, which has been obtained by applying a galvanizing to the cold-rolled steel sheet defined in claim 1 or 2.

4. A method of manufacturing a cold-rolled steel sheet excellent in formability, panel shapeability and dent-resistance consisting essentially of 0.005 to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, not higher than 0.004% by weight of N, not higher than 0.003% by weight of O, 0.04 to 0.23% by weight of Nb, the amounts of Nb and C meeting the relationship given in formula (1), and a balance of Fe and unavoidable impurities, said cold-rolled steel sheet meeting the relationship given in formula (2):

$$1.0<(\text{Nb }\%\times 12)/(\text{C }\%\times 93)\leqq 3.0 \quad (1)$$

$$\exp(\epsilon)\times(5.29\times\exp(\epsilon)-4.19)\leqq\sigma/\sigma_{0.2}\leqq\exp(\epsilon)\times(5.64\times\exp(\epsilon)-4.49) \quad (2)$$

where $0.002<\epsilon\leqq 0.096$, $\epsilon$ represents a true strain, $\sigma/_{0.2}$ represents a 0.2% proof stress, and $\sigma$ represents a true stress relative to $\epsilon$, said process comprising the steps of:

(a) preparing a molten steel and continuously casting said steel;

(b) applying a hot-rolling treatment such that a finish rolling is performed at $(Ar_3-100)°$ C. or more to form a hot-rolled steel band and the rolled steel band is coiled at 500 to 700° C.; and (c) continuously applying a cold-rolling treatment and an annealing treatment to the hot-rolled steel band.

5. A method of manufacturing a cold-rolled steel sheet excellent in formability, panel shapeability and dent-resistance consisting essentially of 0.005% to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, 0.0001 to 0.002% by weight of B, not higher than 0.004% by weight of N, not higher than 0.003% by weight of O, 0.04 to 0.23% by weight of Nb, the amounts of Nb and C meeting the relationship given in formula (1), and a balance of Fe and unavoidable impurities, said cold-rolled steel sheet meeting the relationship given in formula (2)

$$1.0<(\text{Nb }\%\times 12)/(\text{C }\%\times 93)\leqq 3.0 \quad (1)$$

$$\exp(\epsilon)\times(5.29\times\exp(\epsilon)-4.19)\leqq\sigma/\sigma_{0.2}\leqq\exp(\epsilon)\times(5.64\times\exp(\epsilon)-4.49) \quad (2)$$

where $0.002<\epsilon\leqq 0.096$, $\epsilon$ represents a true strain, $\sigma_{0.2}$ represents a 0.2% proof stress, and a represents a true stress relative to $\epsilon$, said process comprising the steps of:

(a) preparing a molten steel and continuously casting said steel;

(b) applying a hot-rolling treatment such that a finish rolling is performed at $(Ar_3-100)°$ C. or more to form a hot-rolled steel band and the rolled steel band is coiled at 500 to 700° C.; and (c) continuously applying a cold-rolling treatment and an annealing treatment to the hot-rolled steel band.

6. A method of manufacturing a galvanized steel sheet, said steel sheet being excellent in formability, panel shapeability and dent-resistance, consisting essentially of 0.005 to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, not higher than 0.004% by weight of N, not higher than 0.003% by weight of O, 0.04 to 0.23% by weight of Nb, the amounts of Nb and C meeting the relationship given in formula (1), and a balance of Fe and unavoidable impurities, said cold-rolled steel sheet meeting the relationship given in formula (2):

$$1.0<(\text{Nb }\%\times 12)/(\text{C }\%\times 93)\leqq 3.0 \quad (1)$$

$$\exp(\epsilon)\times(5.29\times\exp(\epsilon)-4.19)\leqq\sigma/\sigma_{0.2}\leqq\exp(\epsilon)\times(5.64\times\exp(\epsilon)-4.49) \quad (2)$$

where $0.002<\epsilon\leqq 0.096$, $\epsilon$ represents a true strain, $\sigma_{0.2}$ represents a 0.2% proof stress, and $\sigma$ represents a true stress relative to $\epsilon$, said process comprising the steps of:

(a) preparing a molten steel and continuously casting said steel;

(b) applying a hot-rolling treatment such that a finish rolling is performed at $(Ar_3-100)°$ C. or more to form a hot-rolled steel band and the rolled steel band is coiled at 500 to 700° C.; and (c) continuously applying a cold-rolling treatment and a galvanizing treatment to the hot-rolled steel band.

7. A method of manufacturing a galvanized steel sheet, said steel sheet being excellent in formability, panel shapeability and dent-resistance, comprising 0.005 to 0.015% by weight of C, 0.01 to 0.2% by weight of Si, 0.2 to 1.5% by weight of Mn, 0.01 to 0.07% by weight of P, 0.006 to 0.015% by weight of S, 0.01 to 0.08% by weight of sol. Al, 0.0001 to 0.002% by weight of B, not higher than 0.004% by weight of N, not higher than 0.003% by weight of O, 0.04 to 0.23% by weight of Nb, the amounts of Nb and C meeting the relationship given in formula (1), and a balance of Fe and unavoidable impurities, said cold-rolled steel sheet meeting the relationship given in formula (2):

$$1.0\leqq(\text{Nb }\%\times 12)/(\text{C }\%\times 93)\leqq 3.0 \quad (1)$$

$$\exp(\epsilon)\times(5.29\times\exp(\epsilon)-4.19)\leqq\sigma/\sigma_{0.2}\leqq\exp(\epsilon)\times(5.64\times\exp(\epsilon)-4.49) \quad (2)$$

where $0.002<\epsilon\leqq 0.096$, $\epsilon$ represents a true strain, $\sigma_{0.2}$ represents a 0.2% proof stress, and $\sigma$ represents a true stress relative to $\epsilon$, said process comprising the steps of:

(a) preparing a molten steel and continuously casting said steel;

(b) applying a hot-rolling treatment such that a finish rolling is performed at $(Ar_3-100)°$ C. or more to form a hot-rolled steel band and the rolled steel band is coiled at 500 to 700° C.; and (c) continuously applying a cold-rolling treatment and a galvanizing treatment to the hot-rolled steel band.

* * * * *